US006701564B2

(12) United States Patent
Snead

(10) Patent No.: US 6,701,564 B2
(45) Date of Patent: Mar. 9, 2004

(54) SYSTEM AND METHOD FOR POSITIONING A PILE CAP UNDERNEATH AN EXISTING ELEVATED BRIDGE ASSEMBLY

(76) Inventor: Edwin deSteiguer Snead, 3006 Gabriel View, Georgetown, TX (US) 78628

( * ) Notice: Subject to any disclaimer, the term of this patent is extended or adjusted under 35 U.S.C. 154(b) by 0 days.

(21) Appl. No.: 10/155,608

(22) Filed: May 24, 2002

(65) Prior Publication Data

US 2003/0217420 A1 Nov. 27, 2003

(51) Int. Cl.[7] ..... E01D 21/00
(52) U.S. Cl. ..... 14/77.1; 14/75
(58) Field of Search ..... 14/77.1, 2.4, 75, 14/77.3, 78

(56) References Cited

U.S. PATENT DOCUMENTS

| | | | | | |
|---|---|---|---|---|---|
| 3,448,511 | A | * | 6/1969 | Suter | 29/429 |
| 4,103,861 | A | * | 8/1978 | Buchler et al. | 249/20 |
| 4,301,565 | A | | 11/1981 | Weinbaum | 14/1 |
| 4,497,153 | A | * | 2/1985 | Muller | 14/77.1 |
| 4,691,399 | A | | 9/1987 | Kim et al. | 14/2 |
| 5,048,424 | A | | 9/1991 | Madison et al. | 104/9 |
| 5,197,389 | A | | 3/1993 | Glomski et al. | 104/9 |

FOREIGN PATENT DOCUMENTS

FR 2 653 144 A1 4/1991 ..... E01D/21/04

OTHER PUBLICATIONS

English Abstract of FR 2 653 144–A1 entitled "Method for the construction of civil engineering constructions under railway tracks in use," 1–page.

* cited by examiner

*Primary Examiner*—Thomas B. Will
*Assistant Examiner*—Alexandra K. Pechhold
(74) *Attorney, Agent, or Firm*—Howrey Simon Arnold & White LLP

(57) ABSTRACT

A system and method for inserting pre-cast concrete pile caps under wooden railroad bridges without removing essential load bearing rails, cross-ties, and stringers is disclosed. The system and method minimizes the time that the track is closed to normal rail traffic. The system and method uses recycled oil well drill pipes that are cast into pile caps so that female-threaded ends are flushed with an upper surface of the pile caps. Lifting rods have male threaded ends that are used with a multi-point lifting device that allows the pile cap to be slipped under the existing bridge in a number of small incremental steps utilizing the spaces between wooden bridge stringers.

27 Claims, 22 Drawing Sheets

SYSTEM AND METHOD FOR POSITIONING A PILE CAP UNDERNEATH AN EXISTING ELEVATED BRIDGE ASSEMBLY

FIELD OF THE INVENTION

This invention relates generally to railroad bridges and more particularly to a system and method for positioning a pile cap underneath an existing elevated bridge assembly to upgrade the bridge assembly to support a rail assembly.

BACKGROUND OF THE INVENTION

Many existing wooden railroad bridges were built 70 or 80 years ago and are now in the process of being repaired because of deterioration or upgraded to handle the freight loads and speeds of modern trains. Most of the existing wooden railroad bridges are supported by wooden piles topped by wooden pile caps. The repair and upgrade of the bridges includes installing new steel beam piles and topping the new piles with pre-cast, concrete pile caps. Ultimately, the old, wooden piles and caps are removed, and new pre-cast, concrete spans, which are supported by the new caps and piles, are used to support the rail assembly.

A typical concrete pile cap is 17 feet long by three feet wide by three feet deep, and weighs 30,000 pounds. Currently, concrete pile caps are cast with lifting loops at each end so that the pile cap may be lowered straight down from the rail assembly onto the steel piles. This, however, requires that at least portions of all the stingers be removed and that both rails be cut and removed from the rail assembly. Train traffic is interrupted since the rail assembly is separated, and traffic cannot resume until the pile cap is placed on the steel piles and the rail assembly is restored.

It is preferred that upgrading the exiting wooden bridges is done with a minimum interruption of the train traffic. Windows of opportunity for performing the construction are seldom longer than six hours and frequently are as short as forty-five minutes. Current systems and methods in the art do not allow for minimum interruption.

The present invention is directed to overcoming, or at least reducing the effects of, one or more of the problems set forth above.

SUMMARY OF THE INVENTION

A system and method for positioning a pile cap underneath an existing bridge assembly is disclosed. A portion of the rail assembly is removed to define an access area. At least three new piles are installed through the access area. The piles include a center pile and two opposing outer piles. Each pile has a proximal end and a distal end. The distal ends of each pile are driven into a support surface so that each pile generally extends from the support surface to the existing elevated rail assembly. The proximal ends of each pile are removed to define a gap between the piles and the existing elevated rail assembly. A new pile cap is then inserted into the gap. To insert the pile cap, a lifting device and a crane are used. The lifting device is used to incrementally insert the pile cap into the gap. The pile cap is supported on the piles and is used to support a new span for supporting the rail assembly.

The foregoing summary is not intended to summarize each potential embodiment, or every aspect of the invention disclosed herein.

BRIEF DESCRIPTION OF THE DRAWINGS

The foregoing summary, a preferred embodiment, and other aspects of the present invention will be best understood with reference to a detailed description of specific embodiments of the invention, which follows, when read in conjunction with the accompanying drawings, in which.

Figure 1:
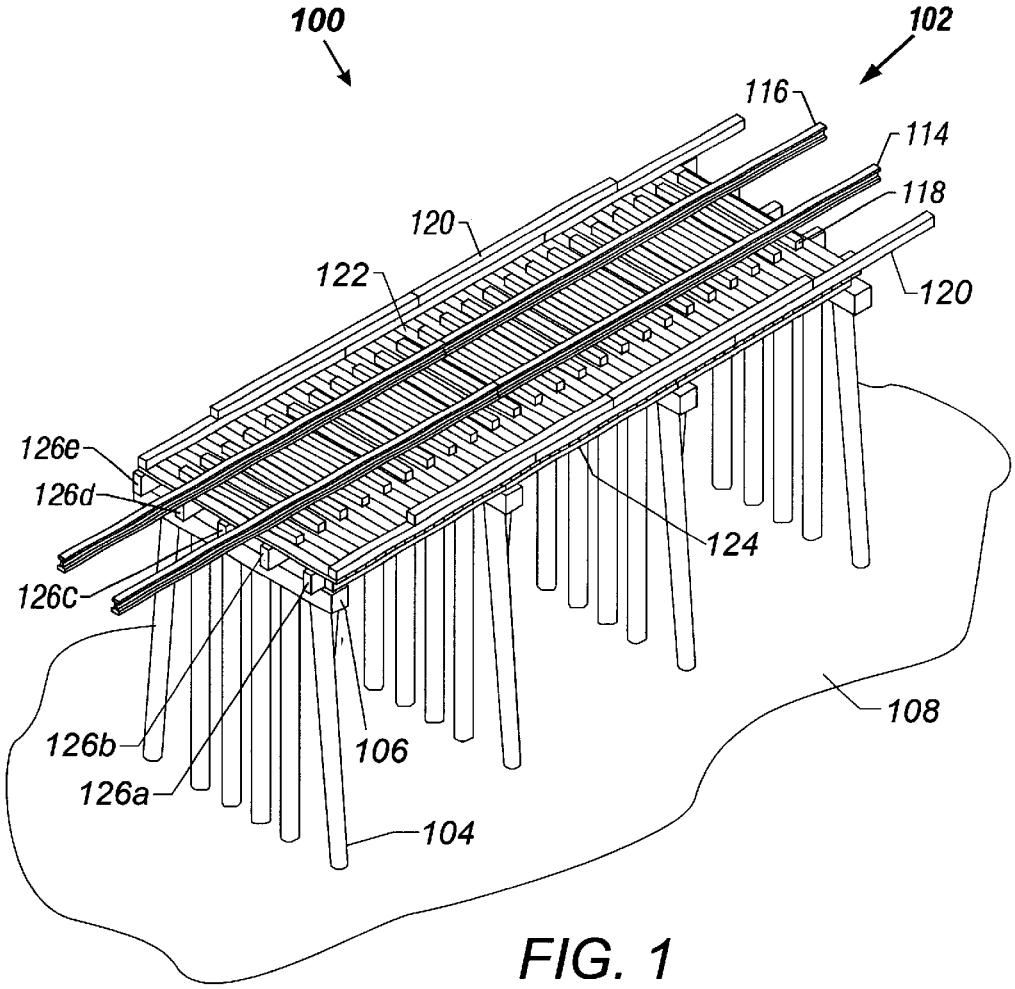
FIG. 1 illustrates a perspective view of an existing bridge assembly having wooden piles and wooden pile caps.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the scope of the invention as defined by the appended claims.

DETAILED DESCRIPTION OF THE INVENTION

FIG. 1 illustrates a portion of an existing bridge assembly 100 typically used to span a low elevational area, such as a valley, canyon, riverbed, or creek bed. The bridge assembly 100 includes an elevated rail assembly 102 supported by wooden pile caps 106 on wooden piles 104. The wooden piles 104 extend into a support surface or ground surface 108.

The rail assembly 102 includes first and second, parallel rails 114 and 16 used by railroad cars and engines. The rails 114 and 116 are supported on a plurality of cross-ties 118 along the length of the rails 114 and 116. The cross-ties 118 are supported on crushed stone ballast (not shown) and a plurality of ballast boards 122, which also extend along the length of rails 114 and 116. The ballast boards 122 are fastened together by a plurality of side ballast retainers 120 located at each end of the ballast boards 122.

The ballast boards 122 are supported on a plurality of outboard non-load-bearing stringers 124 and a plurality of load-bearing stringers 126*a*–126*e*. The non-load-bearing stingers 124 are located underneath and at the ends of the ballast boards 122. The plurality of load-bearing stringers 126*a*–126*e* is supported on the wooden pile caps 106. The stingers on bridge assemblies can have a number of configurations. In one configuration, for example, the load-bearing stringers 126*a*–126*e* extend between adjacent, wooden caps 106 and are spaced approximately 18 inches apart in relation to each other with 126*a* being an inboard stringer and 126*e* being an outboard stringer.

Figure 2A:
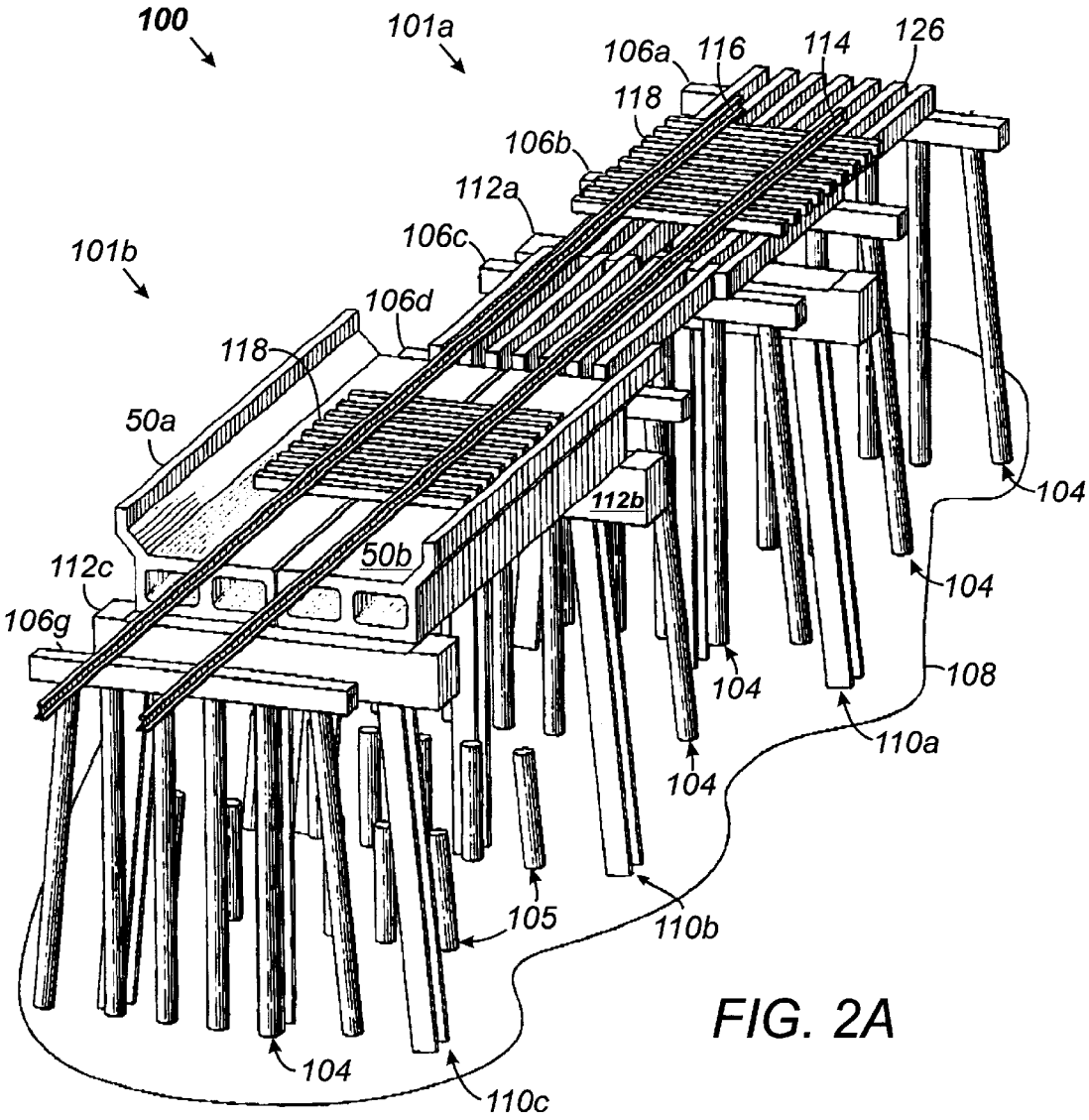
FIG. 2A illustrates the bridge assembly being partially upgraded according to the present invention.
Figure 2B:
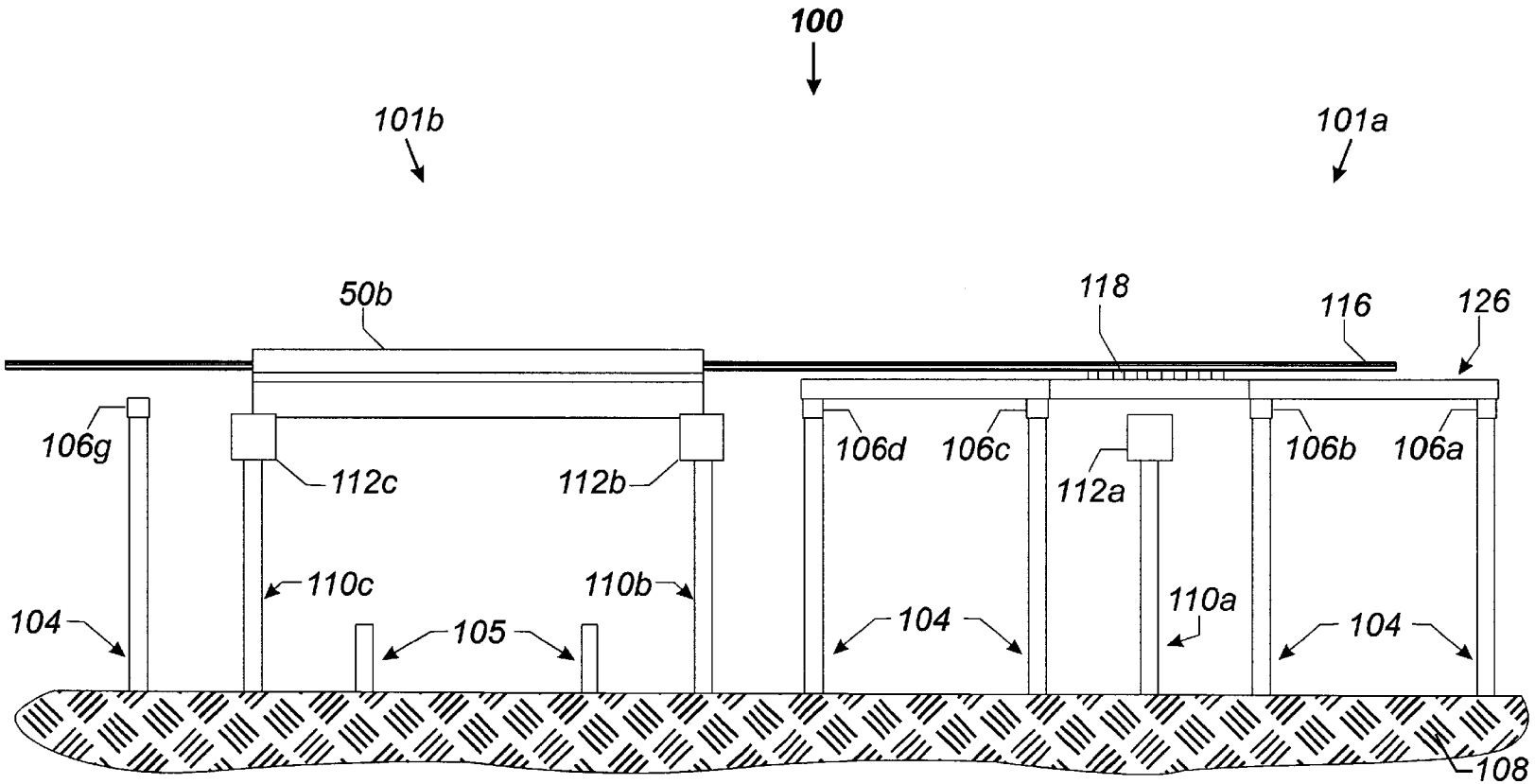
FIG. 2B illustrates a side view of the partially upgraded bridge assembly of FIG. 2A.

Referring to FIGS. 2A–B, the existing, wooden bridge assembly 100 is illustrated partially upgraded according to the present invention. FIG. 2A illustrates a perspective view of the bridge assembly 100 showing only selected components, and FIG. 2B illustrates a side view of the bridge assembly 100 of FIG. 2A. Upgrading the existing, wooden bridge assembly 100 to handle the freight loads and speeds of modern trains involves replacing the existing wooden piles 104 with new piles 110, which are preferably made of steel, and replacing the existing wooden pile caps 106 with new pile caps 112, preferably made of pre-cast concrete. In addition, upgrading the wooden bridge assembly 100 involves replacing the exiting stingers 124 and 126 and ballast boards 122 with new spans 50, which are preferably pre-cast and made of concrete.

It is to be understood that FIGS. 2A–B do not necessarily represent how the bridge assembly 100 would appear during the process of upgrading the assembly according to the present invention. Rather, the partially upgraded bridge assembly 100 is presented to contrast the existing wooden structures (piles 104, caps 106, ballast boards, stingers 126, etc.) with the new structures (piles 110, caps 112, and spans 50) that are used to replace them.

Two sections 101*a* and 101*b* of the assembly 100 are shown for illustrative purposes. The first section 101*a* shows the exiting assembly 100 in an incomplete form. In the first section 101*a*, the rails 114 and 116 are shown supported on existing cross-ties 118, as best described above. For clarity, neither the crushed ballast nor the plurality of ballast boards is shown. For illustrative purposes, a part of the first section 101*a* is shown without the cross-ties, crushed ballast, and ballast boards so that the plurality of stringers 126 can be seen supported on the existing wooden caps 106 and piles 104.

In accordance with upgrading the bridge assembly 100, a new, concrete pile cap 112*a* is shown positioned underneath the stingers 126 between existing wooden pile caps 106*b* and 106*c*. This new, concrete pile cap 112*a* is supported on a plurality of new piles 110*a*. Preferably, the new piles 110*a* are steel H beams having a width of approximately 14 inches. The new piles 110*a* extend from the support surface 108 to the pile cap 112*a*. In the process of upgrading the bridge assembly 100 described in detail below, distal ends of the piles 110*a* are stabilized with the support surface or driven into the ground 108. Opposite, proximal ends of the piles 110*a* are eventually cut off to make room for the new pile cap 112*a* to be positioned below the exiting stingers 126.

To elucidate the system and method described in more detail below, the second section 101*b* of the assembly illustrates the desired result of the present invention. For illustrative purposes, the second section 101*b* is shown in an incomplete form. New piles and caps, such as piles 110*b*–*c* and caps 112*b*–*c*, are installed between every other wooden cap 106 and piles 104. In contrast to the conventional wooden piles 104 and caps 106 that are positioned every 15-feet along the assembly 100, the new piles 110*b*–*c* and caps 110*b*–*c* are positioned approximately every 30-feet along the assembly 100. After installing the new piles 110*b*–*c* and caps 112*b*–*c* under the existing stingers, the old, wooden components are removed. In particular, the old caps are removed, and the old, piles are removed or truncated, such as piles 105. Ultimately, the newly installed caps 112*b*–*c* and piles 110*b*–*c* support pre-cast, concrete spans 50*a* and 50*b*. The concrete spans 50*a*–*b* hold the ballast (not shown), cross-ties 118, and rails 114 and 116 of the rail assembly 102 and replace the old stingers and ballast boards.

The new pile caps 112 are approximately 34-inches in height, while the old wooden pile caps 106 are about 14-inches. As best shown in the side view of FIG. 2B, the top surface of the new pile caps 112 are set about three or four feet lower than the old wooden pile caps 106. This allows for the approximately three feet depth of the pre-cast, concrete bridge spans 50 that will eventually be positioned on the new pile caps 112, such as the span 50*b* supported on caps 112*b* and 112*c* and piles 110*b* and 110*c* in the second section 101*b*. In addition, the position of the concrete piles 112 can include about another foot in depth to accommodate for ballast (not shown). The 30-inch deep span 50*b* replaces the 17-inch wood stingers 126 and the 3-inch wooden ballast boards (not shown).

With the benefit of the overview of the system and method according to the present invention described above, particular steps for positioning new piles and caps underneath an existing elevated bridge assembly to upgrade the assembly will now be discussed in more detail with reference to FIGS.

Figure 3:
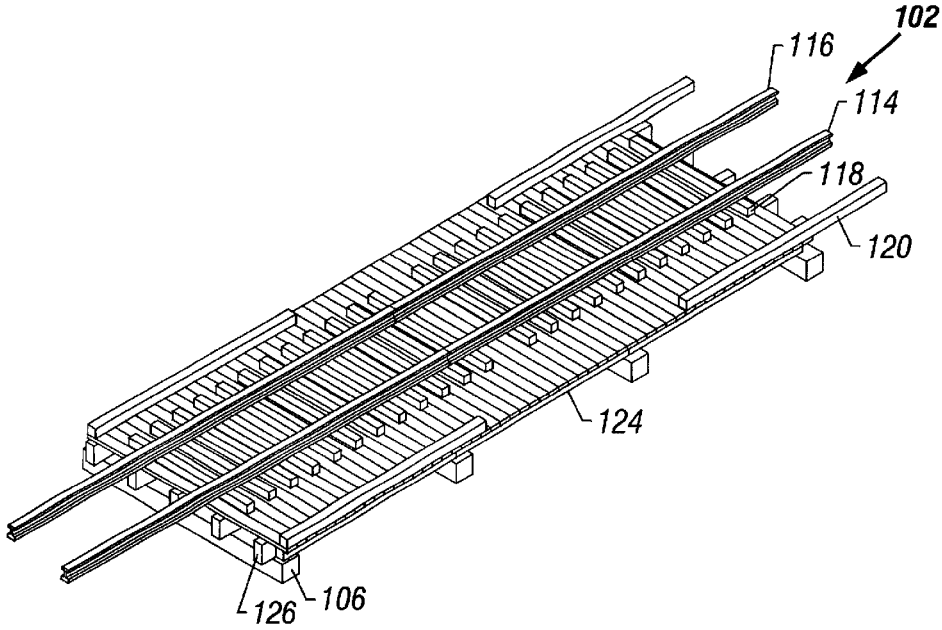
FIG. 3 illustrates a perspective view of the existing bridge assembly of FIG. 1 with a portion of the wooden ballast retainers and cross-ties removed according to the present invention.
Figure 4:
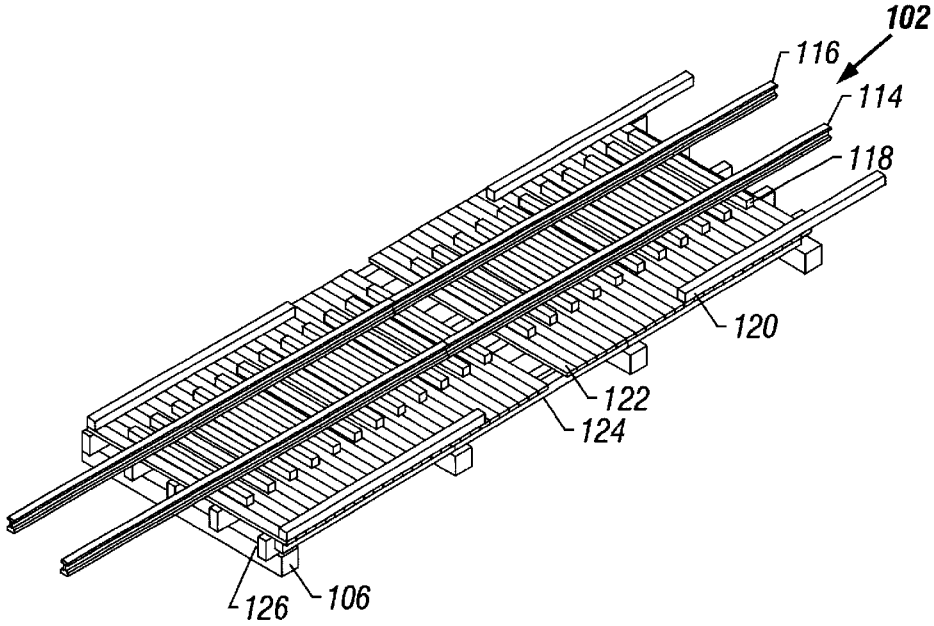
FIG. 4 illustrates the bridge assembly with ballast boards removed according to the present invention.
Figure 5:
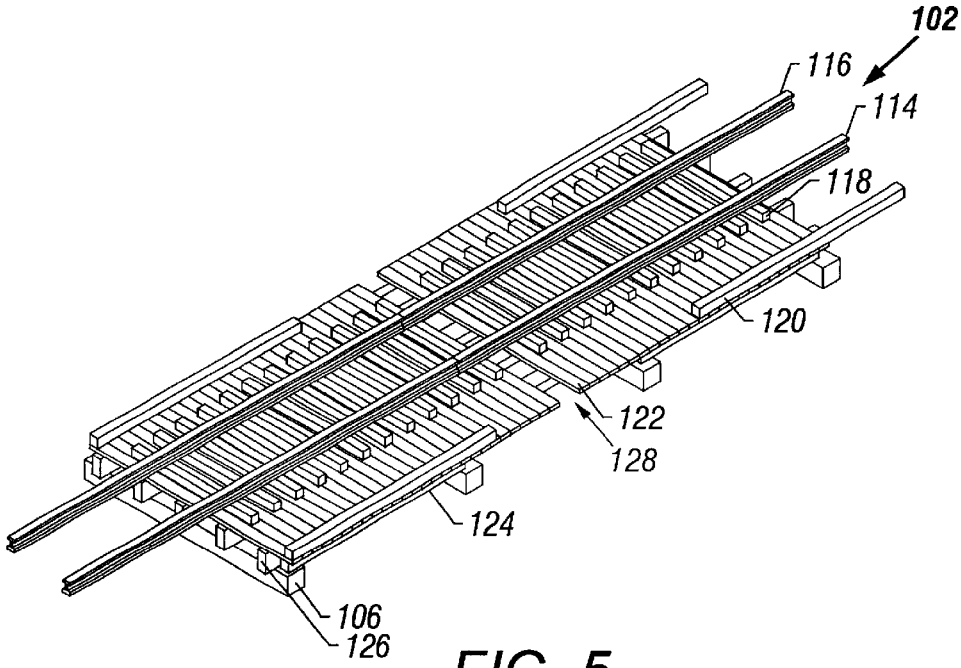
FIG. 5 illustrates the bridge assembly with outboard non-load-bearing stringers removed according to the present invention.

3–24. Referring to FIGS. 3 through 5, initial steps for creating an access area 128 in the assembly 100 according to the present invention are discussed and illustrated. Creation of the access area 128 allows new piles (not shown) to be installed through the rail assembly 102 and allows new pile caps (not shown) to be positioned on top of the new piles. In FIGS. 3–5 and in FIGS. 6–19 described below, the exiting wooden piles used to support the wooden caps 106 are not shown for simplicity.

FIG. 3 illustrates a first step in creating the access area. A plurality of cross-ties 118 is removed from underneath the rails 114 and 116. Side ballast retainers 120 adjacent the removed cross-ties are also removed from the both sides of the rail assembly 102. Although not shown, a three-foot section of crushed stone ballast is removed from the rail assembly 102 as well.

As illustrated in FIG. 4, ballast boards 122 are removed from underneath the rails 114 and 116 where the cross-ties 118 were previously removed. At this point, the stringers 126*a*–126*e* are exposed to view from the top of the rail assembly 102. As illustrated in FIG. 5, outboard, non-load-bearing stringers 124 are removed on both sides of the rail assembly 102. At this point, only the stringers 126*a*–126*e* span across the access area 128. A center stringer may also be removed if necessary.

Figure 6:
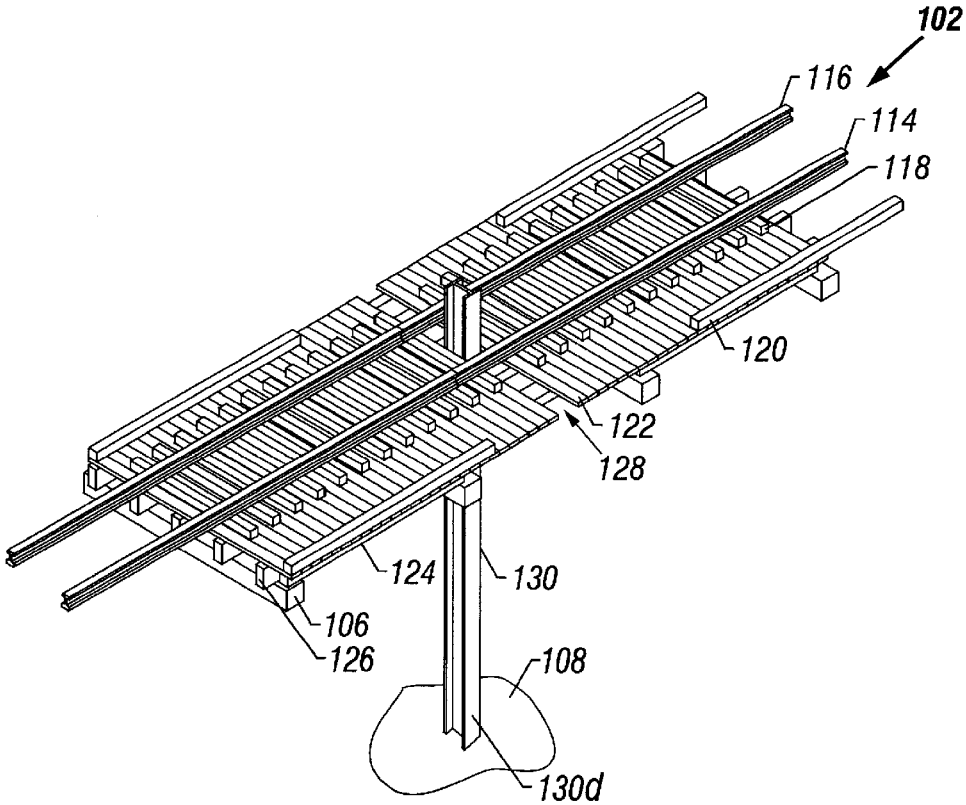
FIG. 6 illustrates a new, center pile positioned through the assembly according to the present invention.

As illustrated in FIG. 6, a center pile 130 is positioned between the rails 114 and 116, between a central pair of stringers 126, and through the access area 128. Alternatively, depending on the spacing of the stringers 126, a portion of one of the stringer may be cut away to make room for the center pile 130. A distal end $130_d$ of the pile 130 is then stabilized to a support surface 108. For example, the distal end $130_d$ is driven into the ground 108 "to refusal" so that the center pile 130 extends generally from the ground 108 to the existing elevated rail assembly 102. Alternatively, the distal end $130_d$ can be stabilized to another support or structure by methods known in the art. In the present embodiment, the pile 130 is preferably a steel H beam having a width of approximately 14 inches, but it will be appreciated that other support members or structures known in the art can be used.

Figure 7:
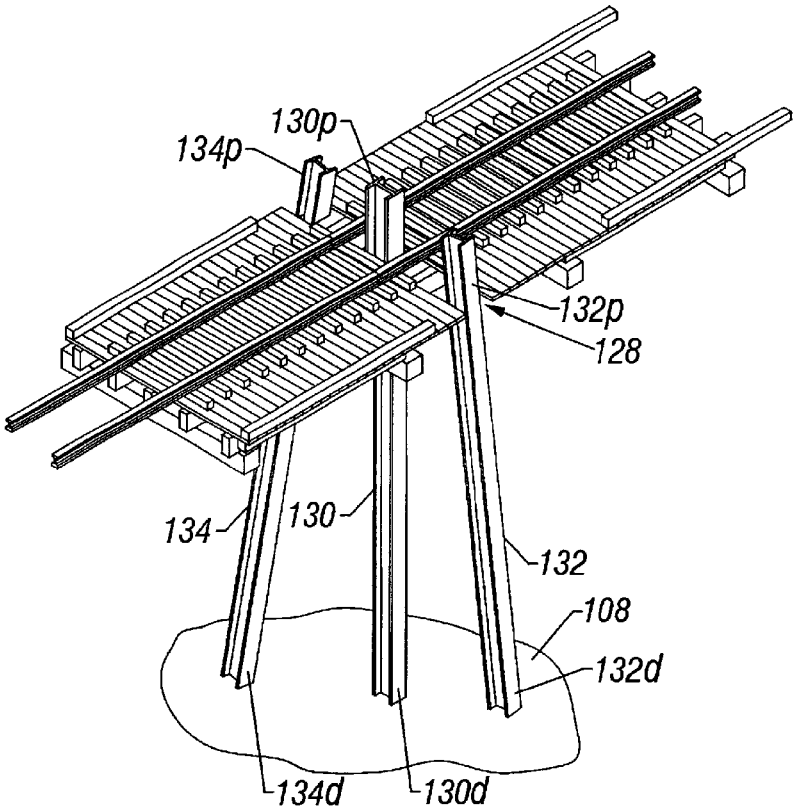
FIG. 7 illustrates the center pile, a first outer pile, and a second outer pile positioned through the assembly according to the present invention.

As illustrated in FIG. 7, a first outer pile 132 and an opposing second outer pile 134 are then positioned through the access area 128. Distal ends $132_d$ and $134_d$ of each of the outer piles are driven into the ground 108. Each of the outer piles 132 and 134 generally extend from the ground surface 108 to the existing elevated rail assembly 102. Preferably, the two outer piles 132 and 134 extend from the ground surface 108 at convergent angles relative to the center pile 130.

Figure 8:
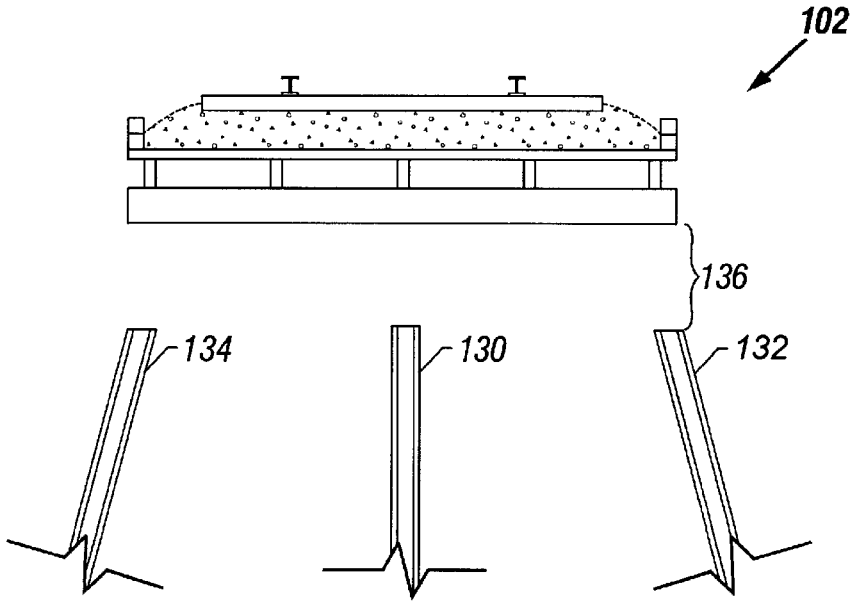
FIG. 8 illustrates a front view of proximal ends removed from the new piles to define a gap according to the present invention.

Proximal ends $130_p$, $132_p$, and $134_p$ of each pile are horizontally cut off to define a generally uniform gap 136 between piles 130, 132, 134 and the rail assembly 102, as illustrated in FIG. 8. The ends $130_p$, $132_p$, and $134_p$ are cut with level tops to a precise height for welding to steel plates on the bottom of a new, pre-cast concrete pile cap (not shown). The proximal ends are cut immediately after the piles are driven into the ground surface 108 so that rail assembly 102 can continue to be used for rail traffic. In the present embodiment, the steel piles 130, 132, and 134 can be cut using a gas/oxygen flame at exactly the height where the cut end will be welded to the new caps. As noted above, it is understood that other members or structures can be used for the new piles. Thus, the step of horizontally cutting proximal ends of the piles may be unnecessary when the piles are not driven into the ground as described above, but are stabilized by other methods or structures.

At this point, the ballast, a substantial majority of cross-ties 118, and the rails 114 and 116 are still in place, and there are no obstacles to normal train traffic. The cross-ties that were removed to allow for driving the new piles can be replaced, and other cross-ties 118 approximately 30-feet away can be removed for driving the next set of piles.

Figure 9:
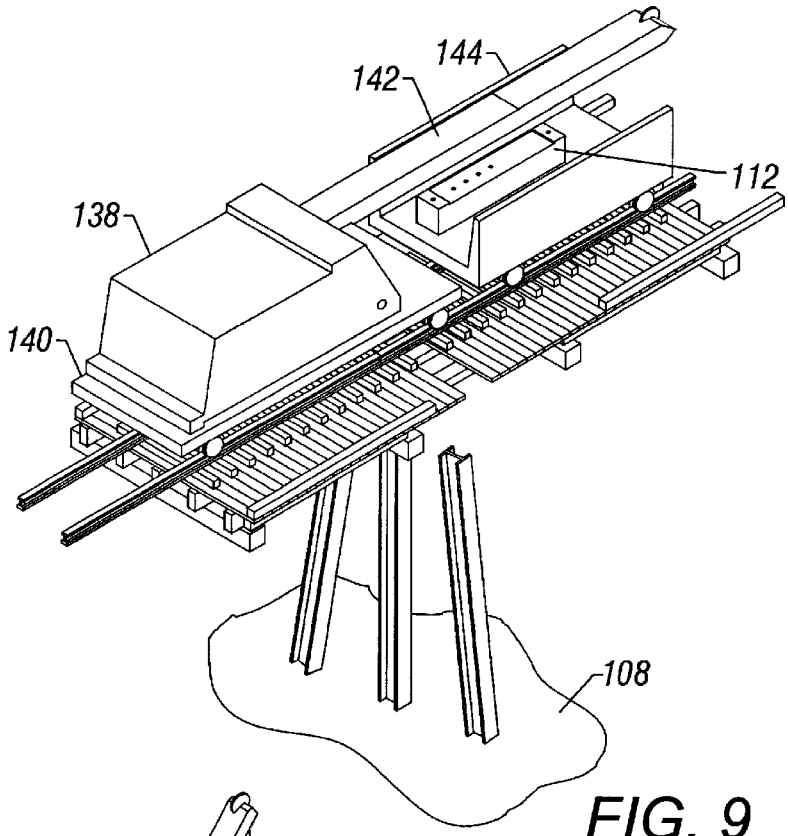
FIG. 9 illustrates a crane and a freight car positioned over the prepared portion of the assembly according to the present invention.

Once the piles 110 are ready, a new, pile cap 112 of pre-cast concrete can be delivered by railroad car on the existing rail assembly 102, as illustrated in FIG. 9. A locomotive crane 138 is moved approximately over the access area 128. Coupled to the crane 138 is a freight car 144 housing the new pile cap 112. The crane 138 and freight car 144 are stopped in a position where the coupling (not shown) between the car 144 and crane 138 does not block the access area 128 from the top. The hand brake is set on the freight car 144, and the coupling is opened.

Figure 10:
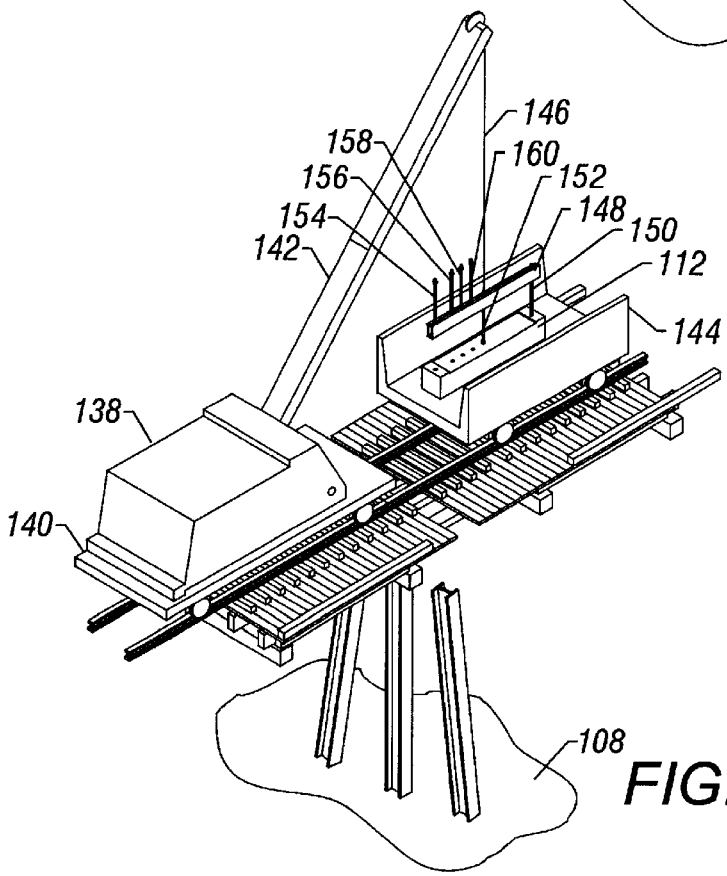
FIG. 10 illustrates a support bar being connected to a new pile cap according to the present invention.
Figure 23:
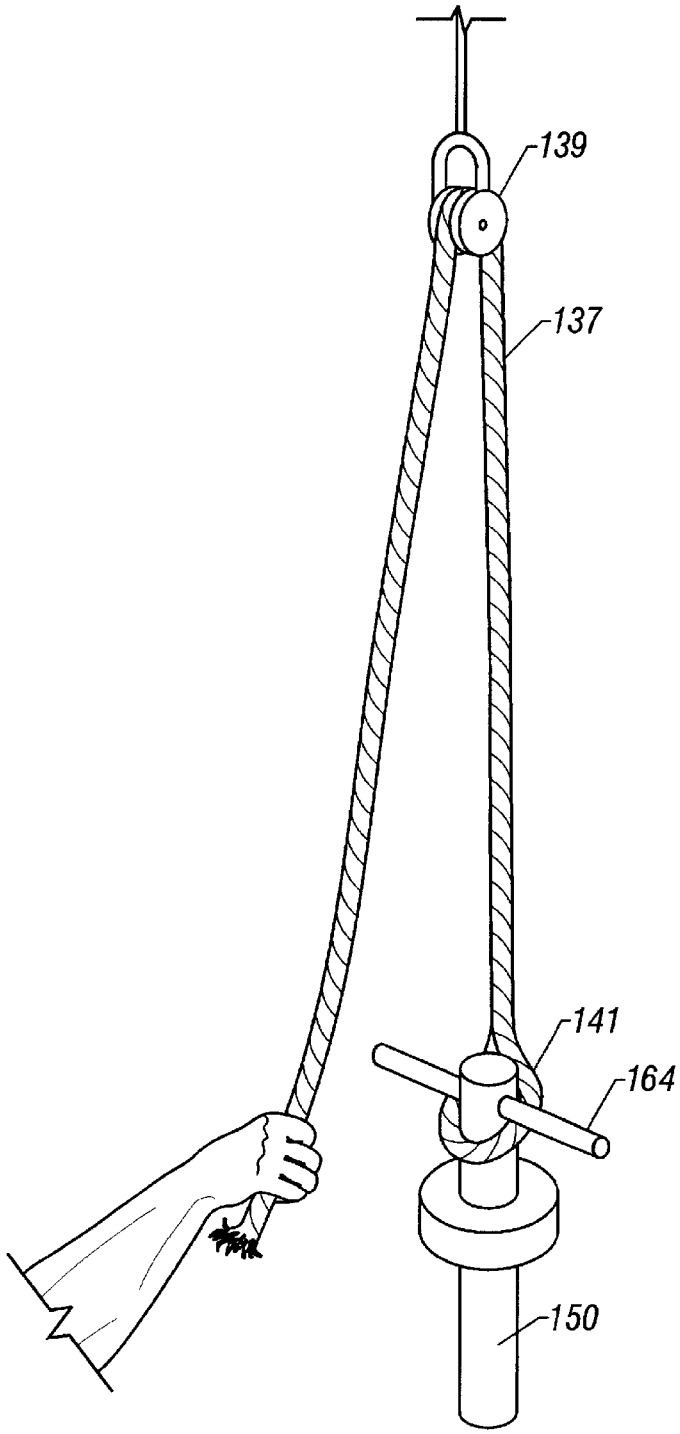
FIG. 23 illustrates a rope used to raise and lower a lifting rod according to the present invention.

As shown in FIG. 10, the crane 138 is moved away from the car 144 to clear the coupling from the access area 128. The crane 138 has a boom 142 and a retractable cable 146. To lift and move the new pile cap 112, a lifting device is used. The lifting device includes an intermediate member or support bar 148 and a plurality of interconnecting members or lifting rods 150–160. Relevant details of the lifting device are provided below with reference to FIGS. 20, 21, and 23.

The cable 146 is connected to a center rod 152, which extends from the support bar 148 along with a first end lifting rod 150. The first end lifting rod 150 and the center lifting rod 152 define a first pair of lifting rods, which are both releasably connected to lifting points on the concrete pile cap 112. Relevant details of the pile cap 112 are provided below with reference to FIGS. 22A–B.

The lifting rods 150, 152 each have an extended position and a retracted position on the support bar 148. In FIG. 10, the first end-lifting rod 150 and the center-lifting rod 152 are shown in the extended position releasably connected to lifting points on the pile cap 112. A second end lifting rod 154, a first mid-portion lifting rod 156, a second mid-portion lifting rod 158, and a third mid-portion lifting rod 160 are shown in the retracted position on the support bar 148.

As will be further described below, each lifting rod corresponds to a lifting point or threaded hole in the pile cap 112 being approximately determined by the spacing of the stingers 126. The lifting rods each weigh approximately 90-lbs. and must be raised approximately eight feet when retracted on the support bar 148. To aid in the lifting of the rods, a double-sheave block is suspended from the crane arm to support two, one-inch diameter ropes. The ropes have eye splices at one end, which are slipped over the tops of the two active lifting rods. In a preferred embodiment shown in FIG. 23, a rope 137 is threaded through a sheave 139. The rope 137 has an eye splice 141 at the working end. It is slipped over the top of one of the lifting rods, for example 150. A pin 164 is placed through the top end of the lifting rod 150 so that the rope 137 may be used to raise and lower the lifting rod 150.

Figure 11:
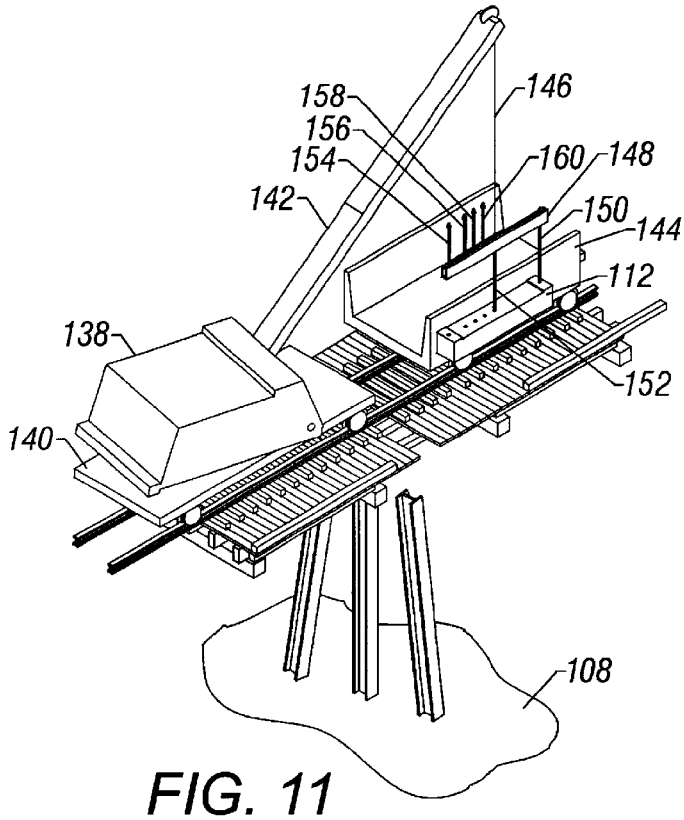
FIG. 11 illustrates the crane lifting the pile cap out of the freight car according to the present invention.

As shown in FIG. 11, the crane 138 lifts the pile cap 112 out of the freight car 144. The weight of the pile cap 112 is transferred through the center-lifting rod 152, while the first end lifting rod 150 helps to stabilize the pile cap 112. The pile cap 112 is lifted high enough to clear the side of the freight car 144 and is swung to the side of the rail assembly 102. The crane 138 preferably rotates approximately 20 degrees or less. The pile cap 112 is positioned parallel to the rails to decrease the required rotation of the crane and the resulting moment arm thereon.

Figure 12:
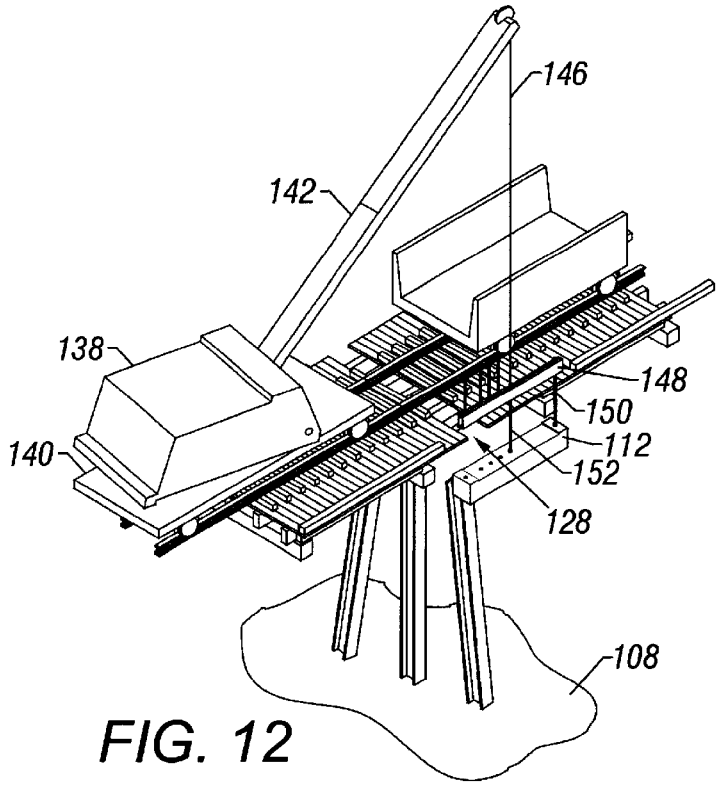
FIG. 12 illustrates the crane lowering the pile cap adjacent the assembly according to the present invention.
Figure 13:
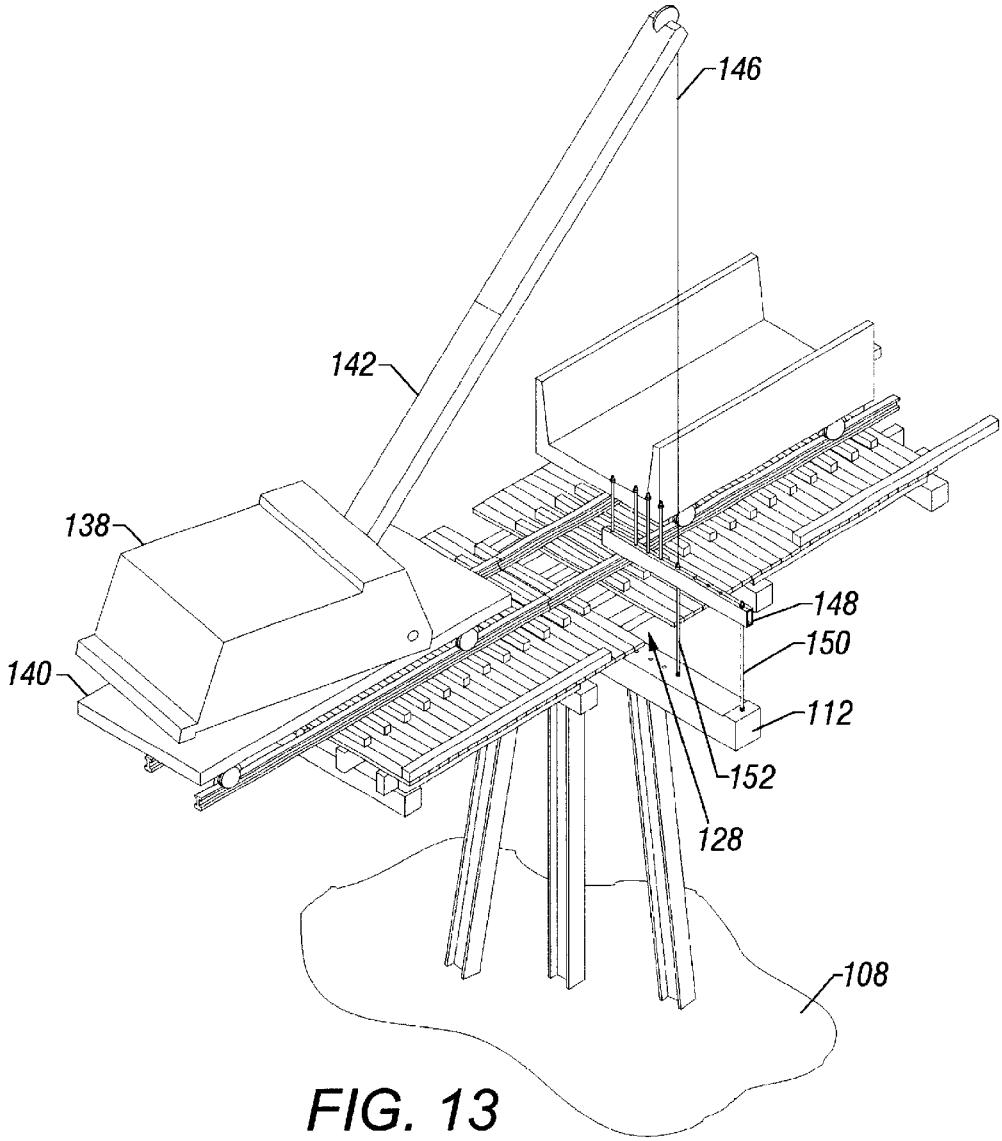
FIG. 13 illustrates the crane rotating the pile cap to be perpendicular to the assembly according to the present invention.

As shown in FIG. 12, the crane 138 lowers the pile cap 112 adjacent the access area 128 to approximately a few inches, such as three inches, above the pile cap's intended final elevation. The crane 138 is then moved away from the access area 128 backward until the crane's lifting arc is directly over the center pile 130. The pile cap 112 is then rotated by a rope (not shown) attached to the first end lifting rod 150 until the pile cap 112 is generally perpendicular to the rail assembly 102, as shown in FIG. 13.

In this preferred embodiment, the locomotive crane 138 is used to lift and move the new concrete pile cap 112. It understood that attention must be made to the maximum moment arm on the crane 138, which can tend to overturn the crane as it holds the approximately 30,000-lb. pile cap 112 adjacent the rail assembly 102. While lowering the cap 112 adjacent the access area 128, the new cap 112 is preferably slightly rotated to clear the existing wooden pile cap 106 at one end and to clear the edge of the bridge assembly at the other end. In this way, the maximum overturning moment arm can be limited to approximately 100-inches measured from the center of the rails 114 and 116 to the lifting cable 146.

If such a locomotive train is not used to move the pile cap adjacent the access area 128, then particular attention must be further paid to the maximum overturning moment arm. For example, in another embodiment, a crane can be carried in a freight car delivering the new pile caps. With a crane in a freight car, the limiting point of the overturning moment arm is a side bearing on top of a truck bolster of the freight car, which is only about 20 inches from an axial centerline of the rails 114 and 116. This imposes a severe limit on the load and or/moment arm that can be handled without danger of overturning the crane and freight car. Accordingly, if other cranes, mechanisms, or methods are used in the art to lift and move the concrete pile caps, particular attention must be paid to the overturning moment. It will be appreciated by one of ordinary skill in the art, however, that a number of cranes, methods, and mechanisms are known in the art for providing an increased maximum moment arm to resist overturning.

Figure 14A:
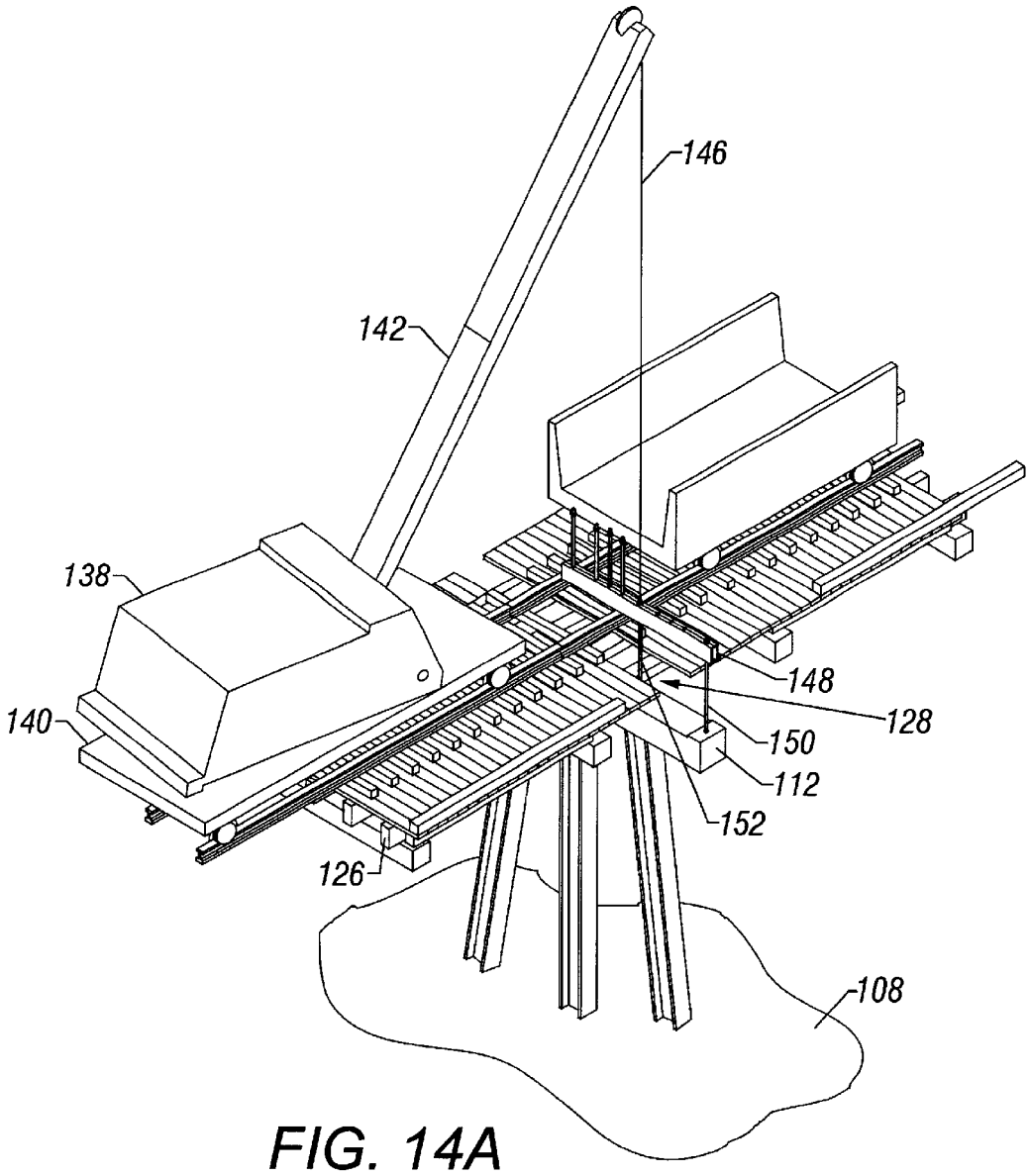
FIGS. 14A–B illustrate the crane utilizing a first pair of lifting rods to position the pile cap to rest on two, new piles according to the present invention.
Figure 14B:
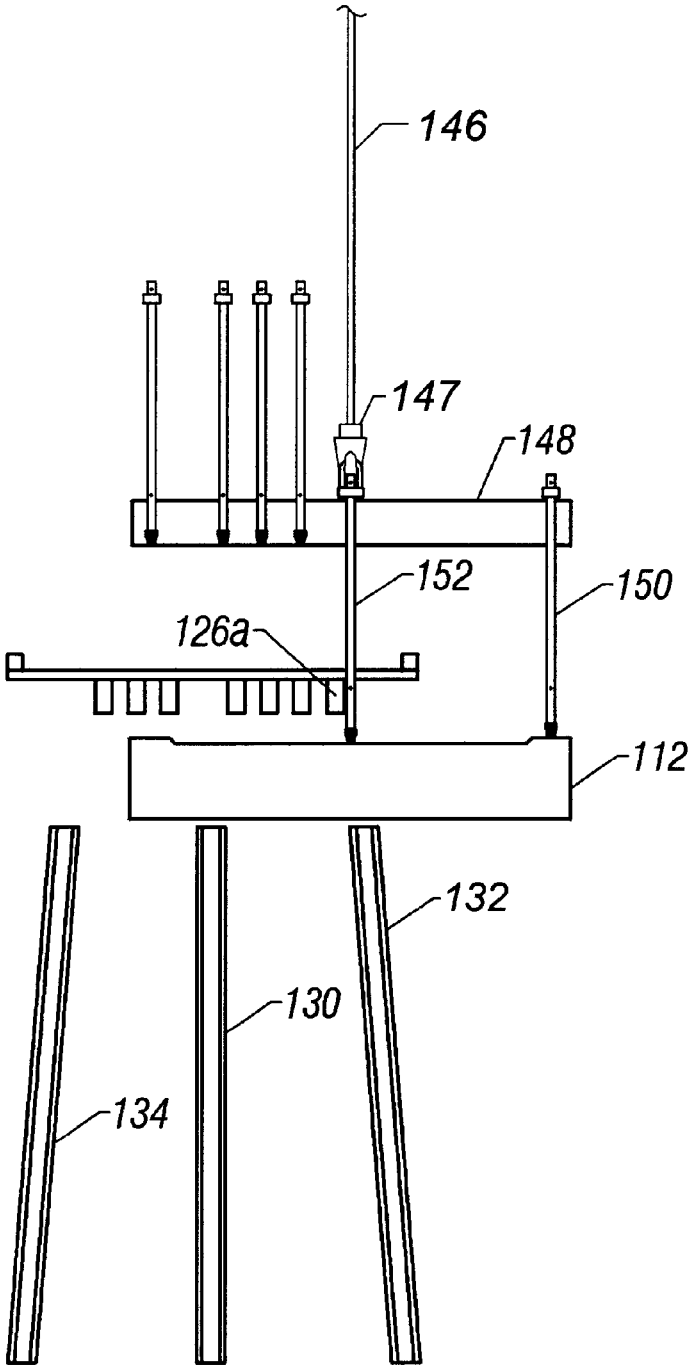

As shown in FIGS. 14A–B, the crane 138 positions one end of the pile cap 112 partially into the access area 128 and gap 136 from the side of the rail assembly until the center lifting rod 152 is adjacent to or in contact with the outboard stringer 126*a*. At this position, an additional lifting point on the pile cap 112 that is approximately 60 inches from the center is visible through the access area 128. As shown in FIG. 14B, the cable of the crane 146 can include a hook or other connector 147 connected to one end of the center lifting rod 152.

Figure 15A:
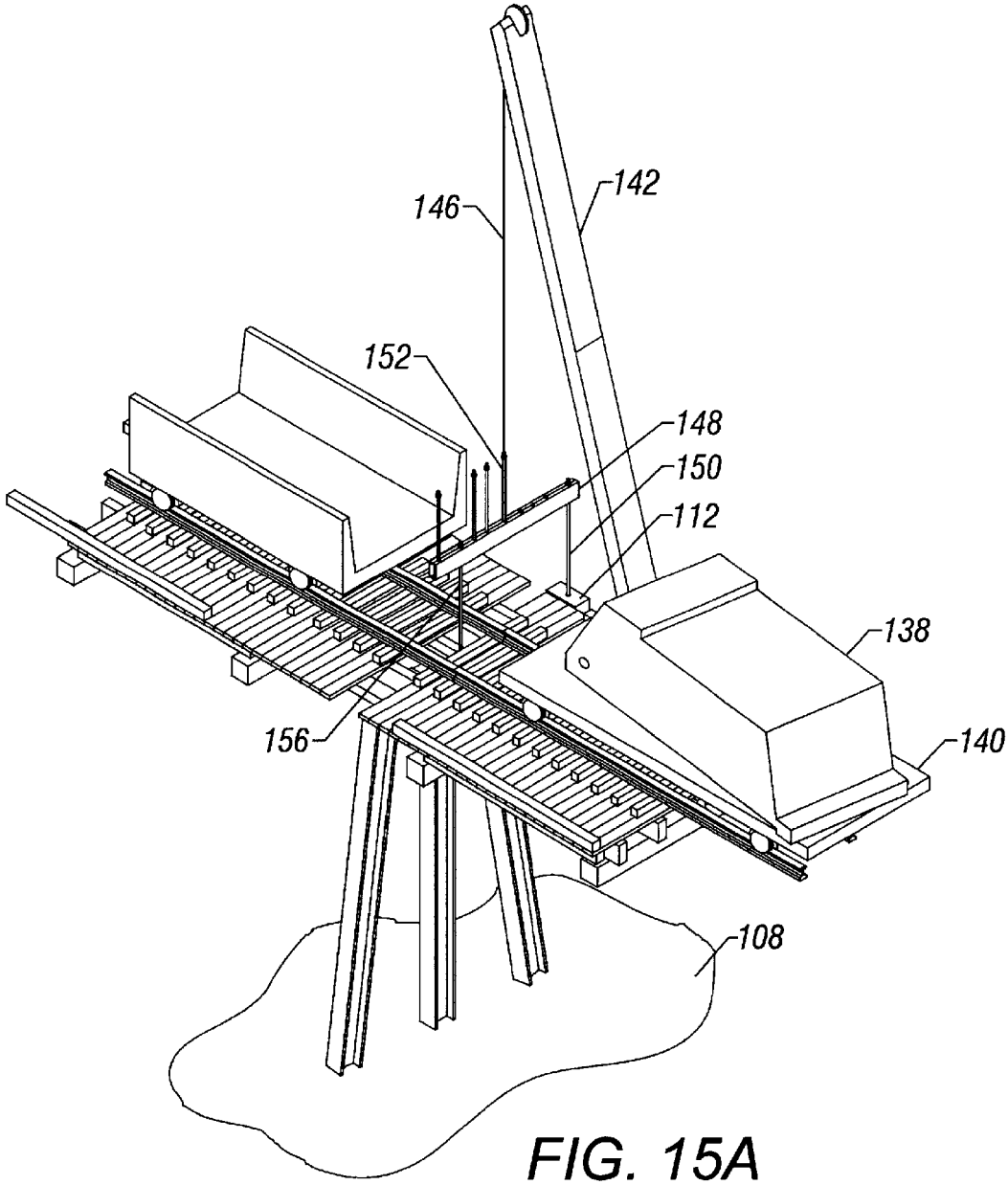
FIGS. 15A–B illustrate the crane positioning the pile cap further into the rail assembly utilizing a second pair of lifting rods with one of the lifting rods being located between the rails.
Figure 15B:
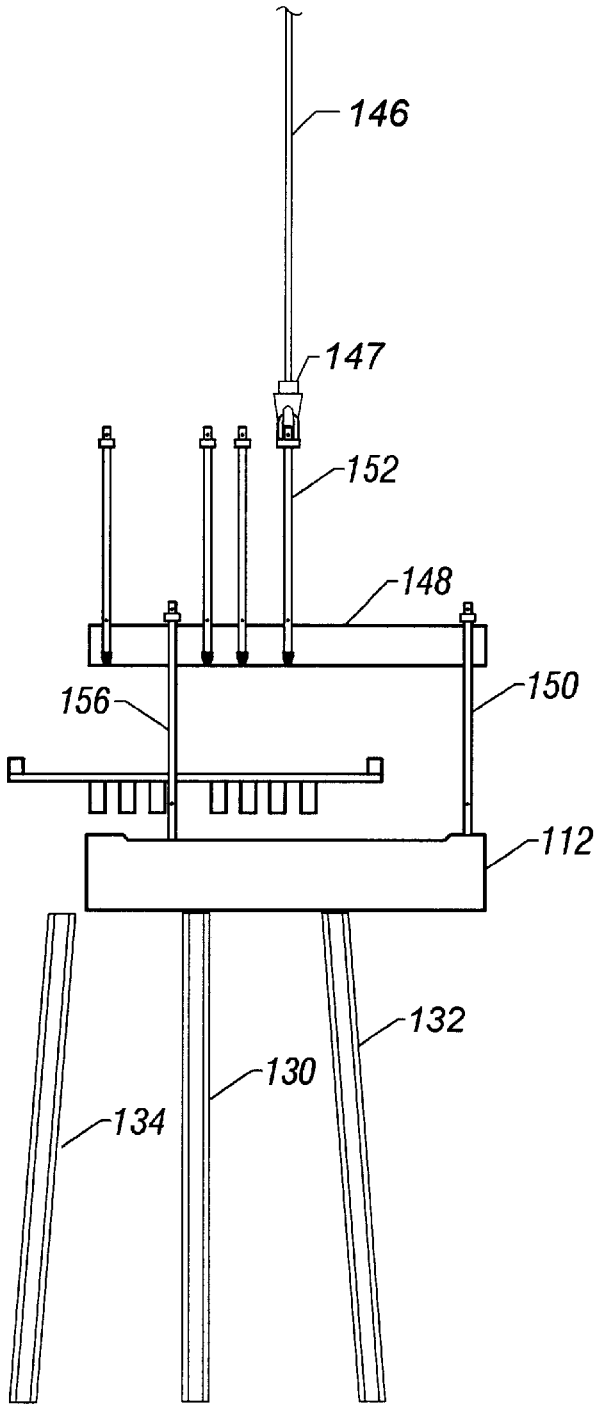

As shown in FIGS. 15A–B, the crane 138 lowers the pile cap 112 onto at least two piles, such as the center pile 130 and the first outer pile 132. The weight of the pile cap 112 is thereby taken off the lifting rods. The first mid-portion lifting rod 156 is extended from the support bar 148 and is releasably connected to the lifting position of the pile cap 112 visible through the access area 128. The center lifting rod 152 is disconnected from the pile cap 112 and is retracted up into the support bar 148, as best shown in the end view of FIG. 15B. Thus, at least two lifting rods are preferably connected to the pile cap 112 when alternating the interconnection of the rods with the pile cap. The center lifting rod 152 and the first mid-portion lifting rod 156 define a second pair of lifting rods extending from the support bar 148. The first end lifting rod 150 stabilizes the pile cap 112, while the center lifting rod 152 is retracted from support bar 148 and the first mid-portion lifting pipe 156 is releasably connected to the pile cap 112.

The crane 138 then lifts the pile cap 112 off the center pile 130 and the first outer pile 132. The crane 138 further positions the pile cap 112 into gap 136 by moving the center of the pile cap 112 approximately 18-inches closer to the center of the rail assembly 102. At this position, an additional lifting point on the pile cap 112 that is approximately 42 inches from the center is visible through the access area 128. The pile cap 112 is then lowered to rest on at least two of the piles, such as center pile 130 and first outer pile 132.

Figure 16A:
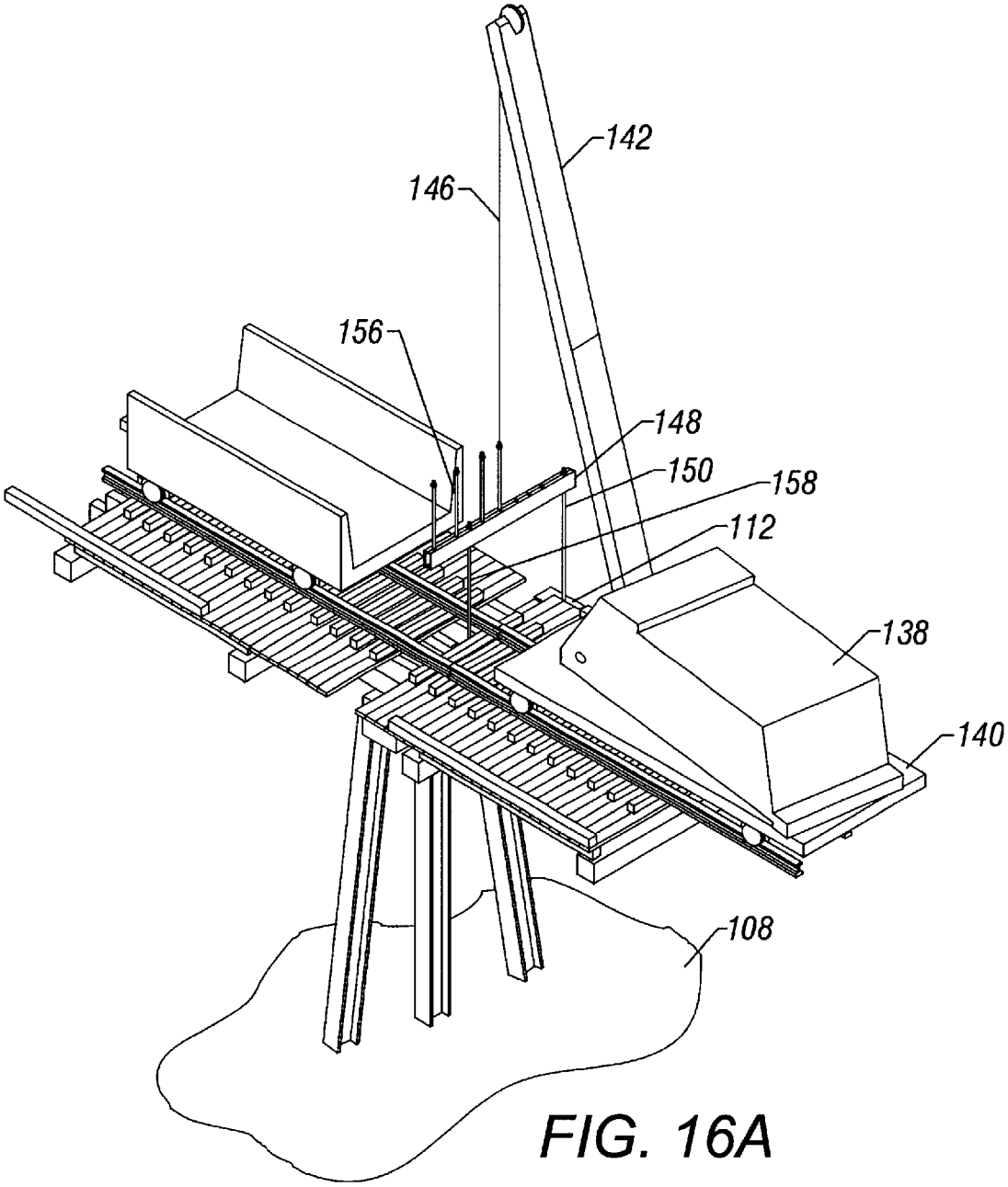
FIGS. 16A–B illustrate the crane positioning the pile cap further into the rail assembly utilizing a third pair of lifting rods with one of the lifting rods being located between the rails.
Figure 16B:
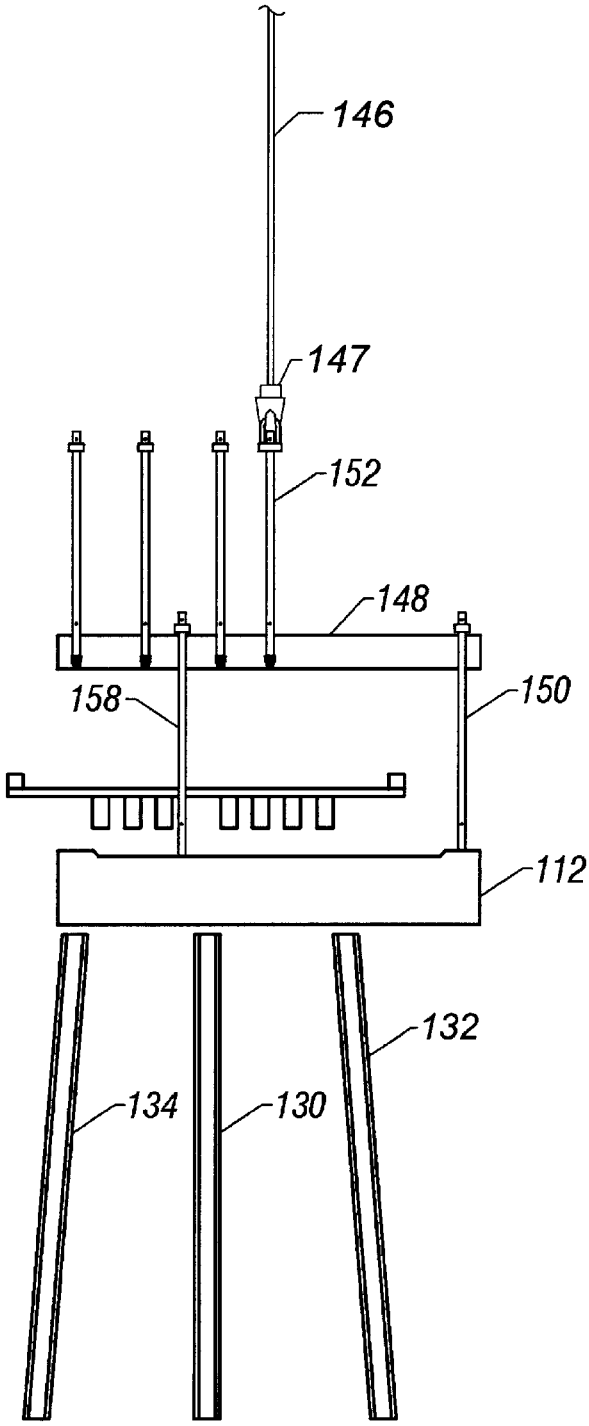

The second mid-portion lifting rod 158 is extended from the support bar 148 and is releasably connected to the pile cap 112, as best shown in the end view of FIG. 16B. The first mid-portion lifting rod 156 is then disconnected from the pile cap 112 and retracted from the support bar 148. The second mid-portion lifting rod 158 and the first end lifting rod 150 define a third pair of lifting rods extending from the support bar 148. The crane 138 then lifts the pile cap 112 off the center pile 130 and the first outer pile 132.

The crane 138 further positions the pile cap into the gap 136 an additional 18 inches toward the center until the second mid-portion lifting rod 158 is adjacent to or in contact with stringer 126*c*. At this point, an additional lifting point on the pile cap 24 inches from the center of the cap is visible through the access area 128. The pile cap 112 is then lowered to rest upon two piles, such as center pile 130 and first outer pile 132.

Figure 17:
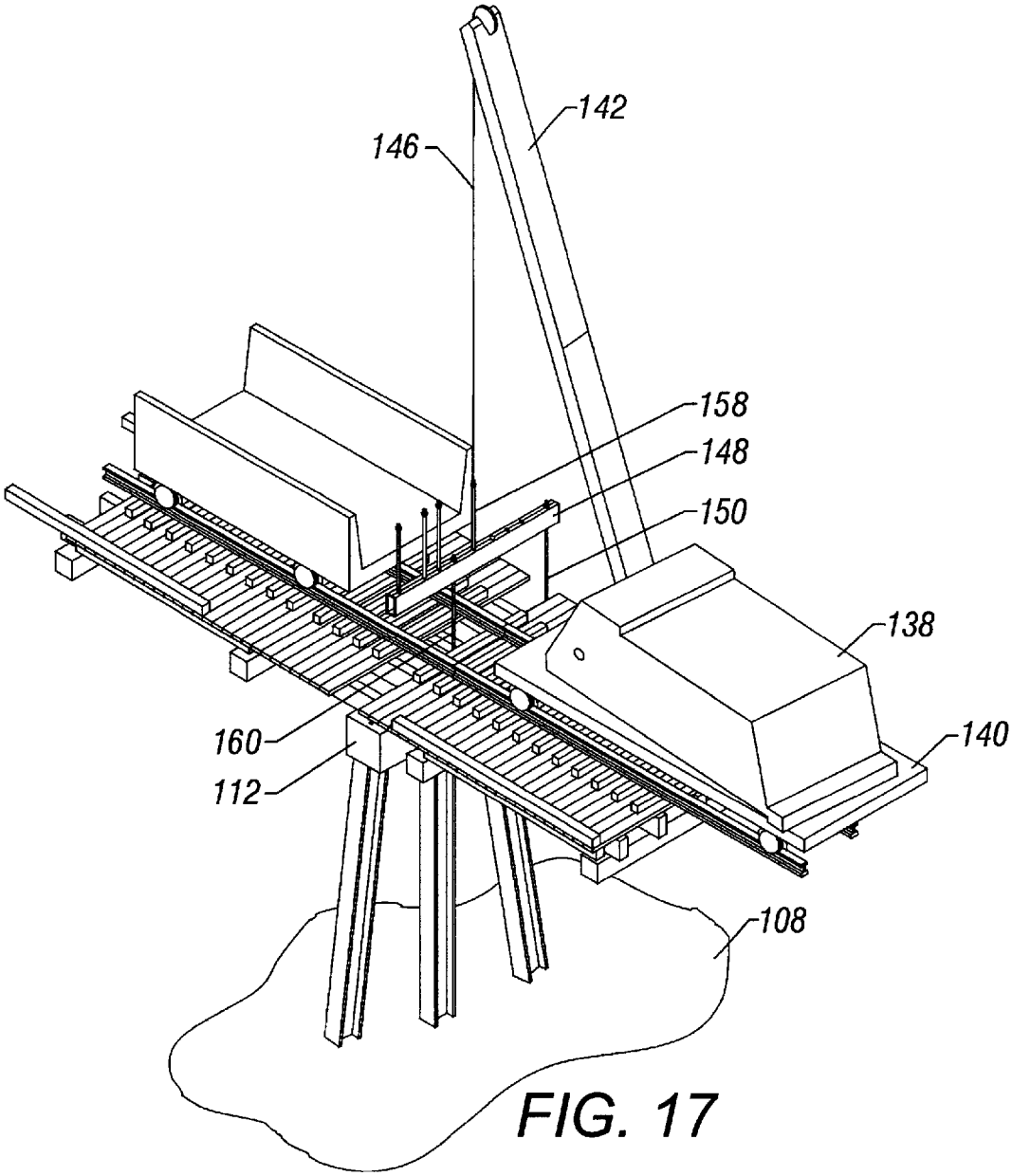
FIG. 17 illustrates the crane positioning the pile cap further into the rail assembly utilizing a fourth pair of lifting rods with one of the lifting rods being located between the rails.

As illustrated in FIG. 17, the third mid-portion lifting rod 160 is extended from the support bar 148 and is releasably connected to the pile cap 112. The second mid-portion lifting rod 158 is disconnected from the pile cap 112 and retracted from the support bar 148. The third mid-portion lifting rod 160 and the first end-lifting rod 150 define a fourth pair of lifting rods.

The crane 138 then lifts the pile cap 112 off the center pile 130 and outer pile 132. The crane 138 further positions the pile cap 112 into the gap 136 an additional 18-inches until the third mid-portion lifting rod 160 is adjacent to or in contact with the next stringer 126*d*. At this point, an outboard lifting point in the pile cap 112 is visible beyond the outboard stringer 126*e*. The pile cap is then lowered to rest upon piles 130, 132, and 134.

Figure 18A:
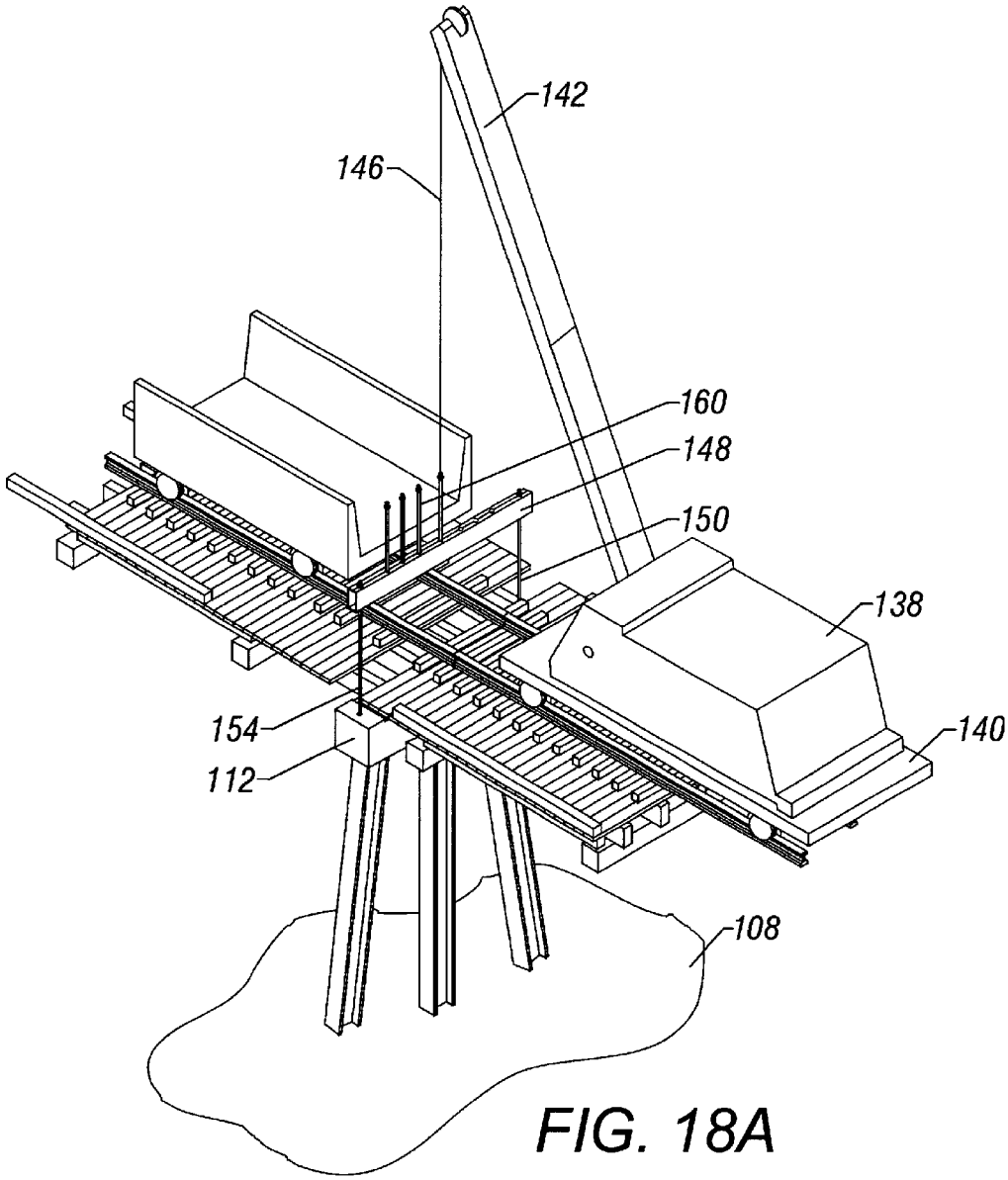
FIGS. 18A–B illustrate the crane positioning the pile cap into a final position utilizing a fifth pair of lifting rods located outside of both rails.
Figure 18B:
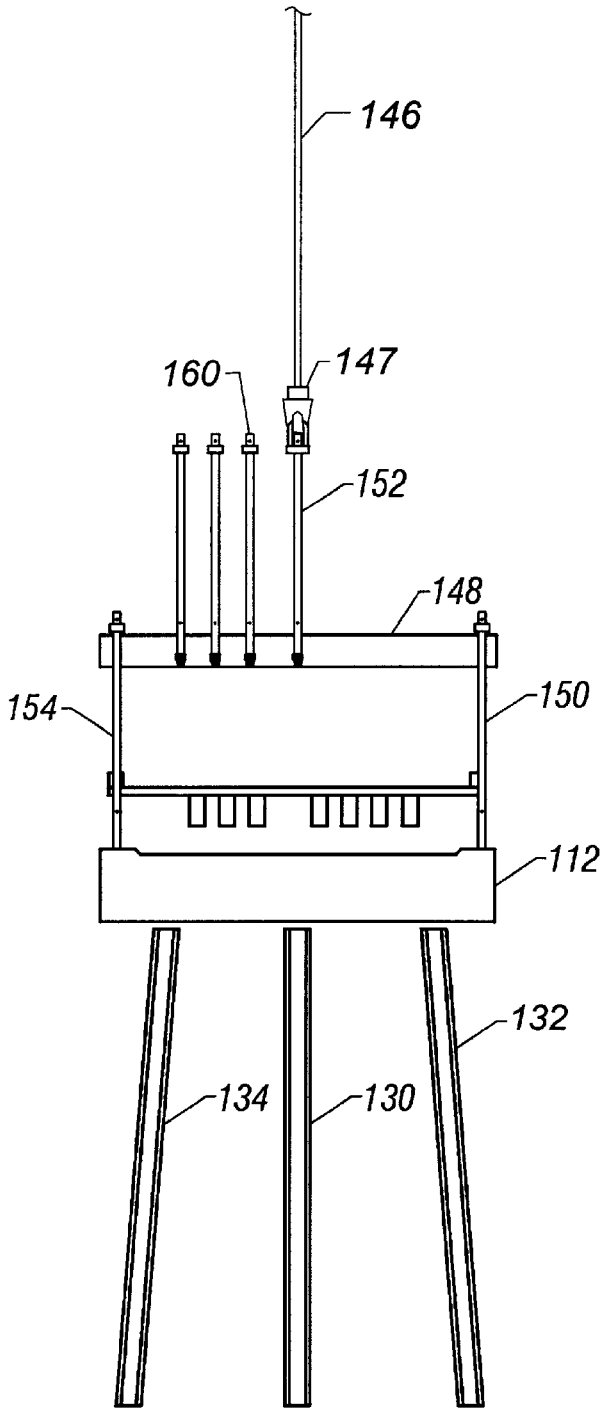

As illustrated in FIGS. 18A–B, the second end lifting rod 154 is then extended from the support bar 148 and is releasably connected to the pile cap 112. The second end-lifting rod 154 and the first end-lifting rod 150 define a fifth pair of lifting rods. Then, the third mid-portion lifting rod 160 is disconnected from the pile cap 112 and retracted from the support bar 148. The crane 138 then lifts the pile cap 112 off piles 130, 132, and 134. The crane 138 further positions the pile cap 112 into the gap 136 so that the pile cap 112 is centered directly under the rail assembly 102. The pile cap 112 is then lowered onto piles 130, 132, and 134 so that the weight of the pile cap 112 is taken off the fifth pair of lifting rods 150 and 154.

Figure 19:
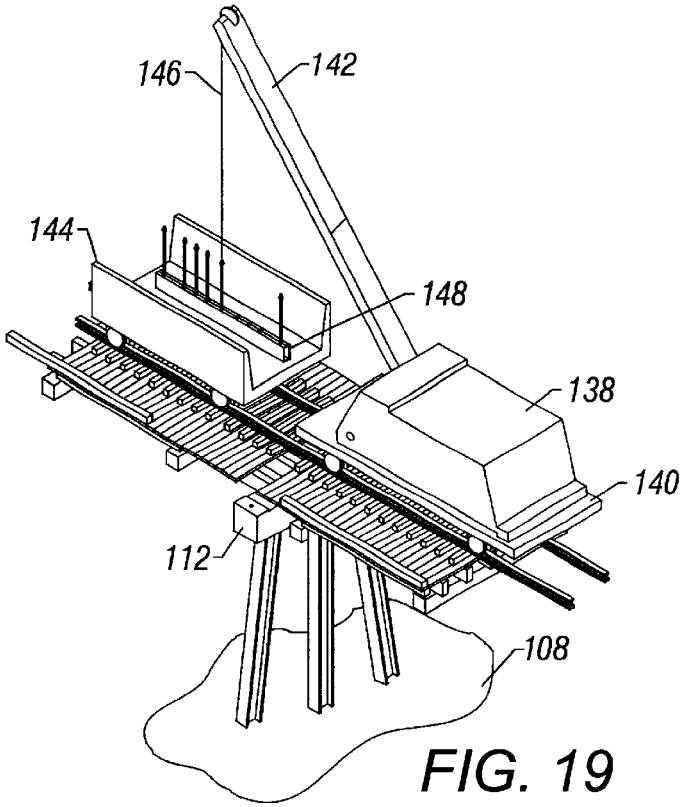
FIG. 19 illustrates the crane placing the support bar into the freight car according to the present invention.

The pile cap 112 includes three steel plates (not shown) that are cast and anchored into a bottom surface of the pile cap 112. These steel plates correspond to the spacing of the piles 130, 132, and 134. The pile cap 112 is welded at the juncture of the steel plates and the piles 130, 132, and 134. The first end lifting rod 150 and the second end lifting rod 154 are then disconnected from the pile cap 112 and retracted from the support bar 148. The crane 138 then lifts the support bar 148 and the lifting rods back into the freight car 144, as illustrated in FIG. 19.

With the new cap 112 and piles 130, 132, and 134 installed, the above system and method according to the present invention can be repeated at further locations along the bridge assembly. As discussed above, new caps and piles are positioned between every other wooden cap and piles or about every 30-feet along the bridge assembly. Once the new caps and piles are installed below the exiting bridge assembly, the old, wooden caps, piles, and ballast can be removed.

In practice of the present invention, it is understood that all the steps discussed above need to be preformed at one location at one time on the bridge assembly 100. Instead, it is preferred that at least some of the steps be performed along the length of the assembly 100 before further steps are performed. For example, creating the access area, driving the new piles, cutting the new piles, and positioning the new caps on the piles can be performed at one location and then further locations along the assembly before the wooden caps and piles are replaced with new, concrete spans. As evidenced herein, the system and method according to the present invention advantageously maintains a substantial portion of the load-bearing components of the rail and bridge assembly and allows the exiting rails and bridge assembly to be used while performing the steps in this manner.

Figure 20:
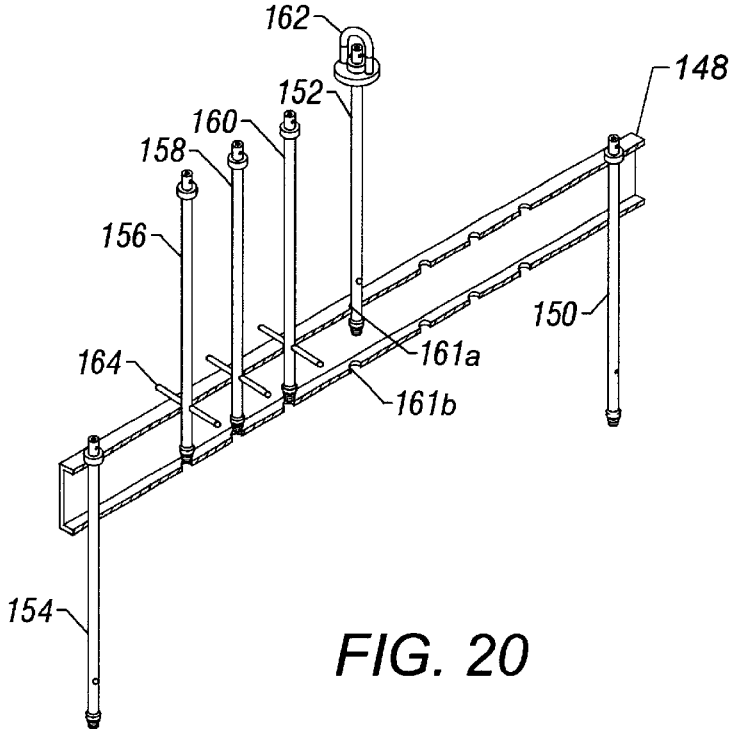
FIG. 20 illustrates an embodiment of a support bar in cross-section having lifting rods according to the present invention.

FIG. 20 illustrates an embodiment of a lifting device according the present invention. The lifting device includes an intermediate member or support bar 148 and a plurality of interconnecting members or lifting rods 150–160. The support bar 148 is illustrated in cross-section to show an internal hollow defined therein. The support bar 148 defines a plurality of first or top apertures 161*a* from a top of the bar to the internal hollow. The support bar 148 defines a plurality of equally located, second or bottom apertures 161*b* from a bottom of the bar to the internal hollow. The bottom apertures 161*b* have a greater dimension than the top apertures 161*a*.

The lifting rods 150–160 are disposed in the plurality of apertures 161*a–b* in the support bar 148. The apertures 161*a–b* are approximately spaced to cooperate with the spacing of the stringers of the rail assembly and with the spacing of the lifting points on the new pile cap. For example, the first mid-portion lifting rod 156 is preferably spaced approximately 60 inches from the center-lifting rod 152. Also, the second mid-portion lifting rod 158 is preferably spaced approximately 42 inches from the center lifting rod 152, and the third mid-portion lifting rod 160 is preferably spaced approximately 24 inches from the center lifting rod 152. This spacing accommodates the typical spacing of stringers in a rail assembly, although it is understood that other arrangements of spacing may also be applicable to the present invention. In an alternative embodiment, three additional lifting rods (not shown) can be located between the center lifting rod 152 and the first end lifting rod 150. The spacing of the three, additional lifting rods can be similar to the first, second, and third mid-portion lifting rods from the center.

The first end lifting rod 150 and the second end lifting rod 154 are shown in the extended position in relation to the support bar 148. The center lifting rod 152, the first mid-portion lifting rod 156, the second mid-portion lifting rod 158, and the third mid-portion lifting rod 160 are all shown in the retracted position. Removable pins 164 are used to hold the rods in the retracted position. Preferably, all of the lifting rods can be retracted so that a threaded end can be housed in the internal hollow of the support bar, which protects the threads from damage when not in use.

The center-lifting rod 152 is movably disposed in central apertures of the support bar 148 between extended and retracted positions. The center-lifting rod 152 has a lower end capable of releasably connecting to the cap at one of the lifting points when in the extended position (not shown). The lower end is also capable of engaging the inner hollow of the support bar 148 adjacent the upper aperture 161*a* when in the retracted position as shown in FIG. 20. The center-lifting rod 152 also has an upper end capable of connecting to the cable. In one embodiment, the center-lifting rod 152 includes a swivel and shackle 162 so that the cable of the crane can be attached to the center-lifting rod 152. The upper end is also capable of engaging the outer surface of the support bar 148 adjacent the upper aperture 161*a* when in the extended position (not shown).

The plurality of other lifting rods 150, 154, 156, 158, and 160 are also movably disposed in the apertures 161*a–b* of the support beam between extended and retracted positions. These rods have a lower end capable of releasably connecting to the cap at one of the lifting points when in the extended position. These rods also have an upper end capable of engaging outside surface of the support beam adjacent the upper aperture 161*a* when in the extended position, such as rods 150 and 154 are shown in FIG. 20.

Figure 21:
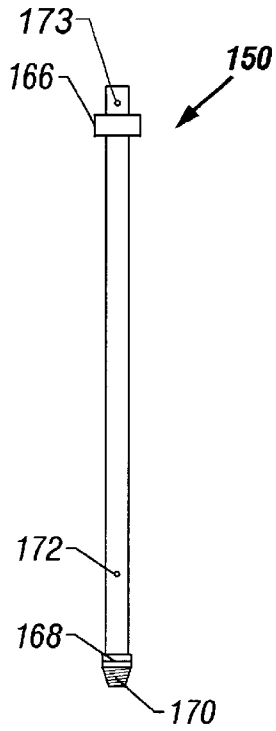
FIG. 21 illustrates an embodiment of a lifting rod according to the present invention.

FIG. 21 illustrates an embodiment of a lifting rod according to the present invention. Shown by way of example is a first end lifting rod 150 with an upper collar 166 at an upper end of the lifting rod and a large diameter area 168 at a lower end of the lifting rod. The upper collar 166, which may be welded to the rod, is a stop to keep the lifting rod 150 from sliding out of the support bar when the pile cap is being lifted. Adjacent to the large diameter area 168 is a male member or tapered threaded section 170 for releasably connecting to the cap. The lifting rod 150 further includes an aperture 172 for a pin, such as the pin 164 in FIG. 20, to hold the rod 150 in the retracted position in the support bar. The lifting rod also includes another aperture 173 receiving the pin to retract and extend the rod in the support bar. The male member 170 on the rod 150 can be threaded to a lifting point on the pile cap by a hydraulic motor on the crane under the remote operation of the operator.

Figure 22A:
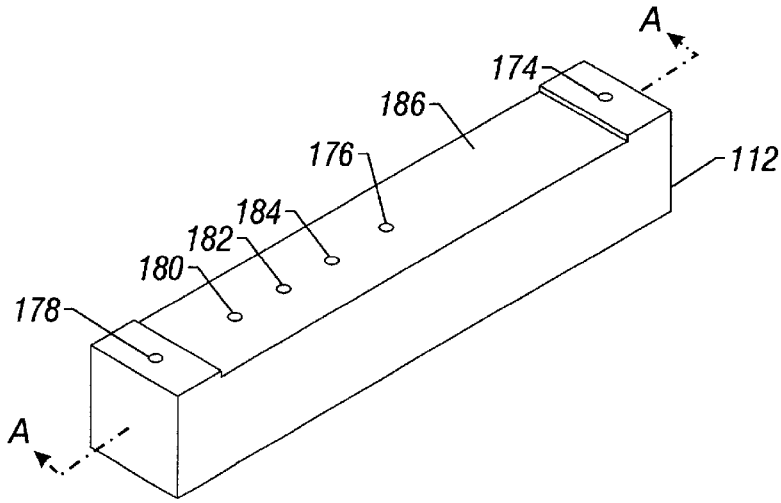
FIG. 22A illustrates a perspective view of an embodiment of a pile cap according to the present invention.
Figure 22B:
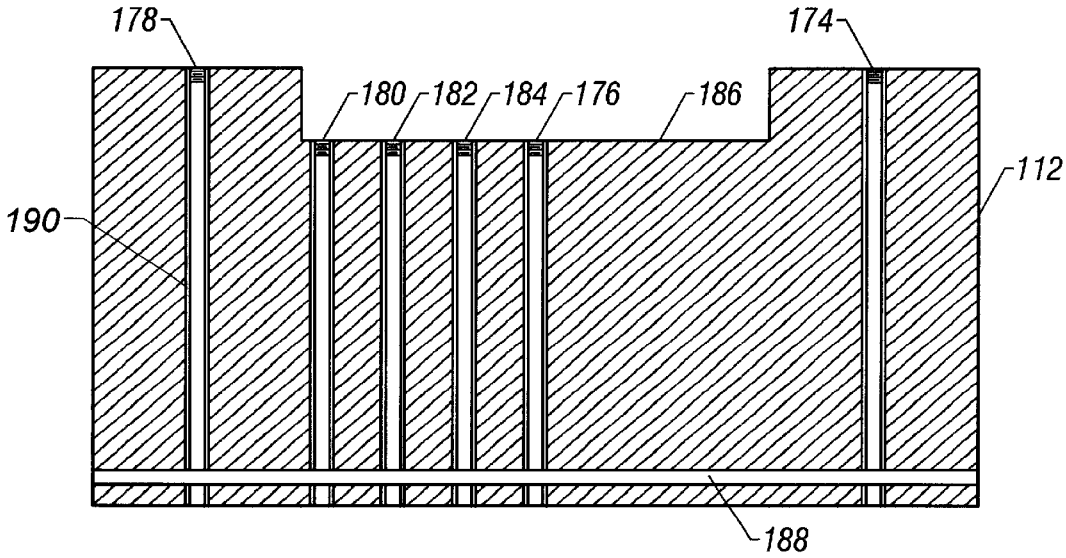
FIG. 22B is a cross sectional view of FIG. 22A taken from line A—A.

FIGS. 22A–B illustrate an embodiment of a pile cap 112 according to the present invention. The pile cap 112 includes a plurality of lifting points or threaded holes 174, 176, 178, 180, 182, and 184 used for the lifting rods. The lifting points are positioned along a longitudinal axis of the pile cap 112. In particular, the pile cap 112 includes a first outboard-threaded hole 174 and a center threaded hole 176 at the center of the pile cap 112. Opposite the outboard-threaded hole 174 is a second outboard-threaded hole 178. Spaced apart between the center threaded hole 176 and the outboard-threaded hole 178 is a first threaded hole 180, a second threaded hole 182, and a third threaded hole 184. The threaded holes on the pile cap 112 are spaced to match the spacing of the lifting rods spaced across the support bar 148.

The releasable connection between the threaded holes and the lifting rods is made by mating the threads of the lifting rods with the appropriate threaded hole of the pile cap 112. The load bearing surface 186 is adapted to support new pre-cast concrete bridge spans, which in turn support the existing elevated rail assembly. The pile cap 112 can further include three additional threaded holes located between the center-threaded hole 176 and the inboard-threaded hole 174 so that the pile cap 112 is symmetrical about the center.

Past attempts of providing the lifting points or threaded holes in the pile cap 112 involved welding threaded steel nuts to reinforcing steel that was then cast in the material of the cap. It has been found that the heavy load of the pile cap striped the threads of the welded nuts. Thus, as best shown in FIG. 22B, the threaded holes 174, 176, 178, 180, 182, and 184 according to the present invention are preferably formed from cut lengths of oil well drilling pipe 190. The pipes 190 are attached to reinforcing steel 188 and then cast into the concrete when the cap 112 is formed. The oil well drilling pipe 190 is internally threaded and is flush with the load bearing surface 186 of the cap 112. The flush ends of the pipe 190 will not interfere with the new, pre-cast concrete spans to be supported on the load bearing surface 186.

The threaded holes 174, 176, 178, 180, 182, and 184 are tapered to provide automatic alignment with the threaded section of the lifting rods, such as section 170 in FIG. 21. The threads are very coarse so that only a few turns of the lifting rod is required to make the releasable connection. As is known in the art, the threads of the oil well drilling pipe 190 are designed to support thousands of feet of interconnected drill pipe, which can impose loads of 100,000-lbs. or more on couplings of the upper pipes. This is many times the weight of the pile cap 112 to be lifted. As discussed above, at least two lifting rods are releasably connected to the lifting points on the cap 112. Thus, the internal threads of two pipes 190 are adequately capable of sustaining the approximately 30,000-lbs. load of the pile cap 12 when coupled to at least two lifting rods.

Preferably, the pile cap 112 has a reinforcement bar 188 extending through the threaded oil well drilling pipes 190. Prior to the pile cap 112 being cast with concrete, holes are drilled in the oil well drilling pipes 190 for interconnecting the reinforcement bar 188 with the pipes 190. The reinforcement bar 188 is preferably steel re-bar and is preferably disposed through the holes in the pipes 190 and not welded to them. The reinforcement bar 188 helps to retain the pipes 190 in the pile cap 112 when lifted. As at the tops of the pipes, the lower ends of the pipes 190 are flush with the bottom of the pile cap 112. In addition, the bottom ends of the pipes 190 are open, and the pipes 190 are able to drain rain water.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A system for upgrading an existing bridge assembly with new structures using a crane with a cable, system comprising:

a pile cap for supporting a portion of the new structures having a plurality of lifting points formed therein, wherein the plurality of lifting points formed in the pile cap comprises a plurality of pipes cast in the pile cap, each pipe having internal threads at an end adjacent a load-bearing surface of the pile cap;

an intermediate member having a plurality of support locations being substantially equally spaced as the lifting points; and a first interconnecting member disposed at one of the support locations and being connectable to the cable, the first interconnecting member capable of supporting the intermediate member and capable of releasably connecting to one of the lifting points; and a plurality of second interconnecting members disposed at the other support locations, the second interconnecting members each being capable of interconnecting the intermediate member with one of the plurality of other lifting points.

2. The system of claim 1, wherein the plurality of lifting points on the pile cap comprises:

a first end point adjacent one end of the pile cap, a second end point adjacent another end of the pile cap, a central point between the first and second end points, and one or more third points being substantially spaced at predetermined distances between the central point and at least one of the end points.

3. The system of claim 1, wherein the pipes each comprise an internally threaded end of an oil well drilling pipe.

4. The system of claim 1, wherein the internal threads of at least two of the pipes are capable of sustaining a load of the pile cap when coupled to at least two of the interconnecting members.

5. The system of claim 1, wherein the pile cap comprises a reinforcing member cast in the pile cap and interconnected with the plurality of pipes.

6. The system of claim 1, wherein the intermediate member comprises a bar having a plurality of apertures defined therethrough at the support locations.

7. The system of claim 1, wherein the first interconnected member comprises a central rod having first and second ends, the first end having a rotatable member connectable with the cable, the second end having a male member threadable in a centrally loaded lifting point.

8. The system of claim 1, wherein the second interconnecting members each comprise a rod having first and second ends, the first end having a stop capable of engaging the intermediate member, the second end having a male member threadable in one of the lifting points.

9. The system of claim 8, wherein the male members are capable of being housed in the intermediate member when in a retracted position.

10. A system for handling components of a structure using a cable of a crane, the system comprising:

a component of the structure, comprising:

a body having a first surface, a first member in the body having a first threaded end exposed on the first surface, a reinforcing member cast in the body of the component and connected to the first member, wherein the reinforcing member comprises a bar passing though a hole drilled through the first member; and a device for moving the component, the device being connectable to the cable and comprising a second member having a second treaded end, the second threaded end capable of threading with the first threaded end of the first member.

11. The system of claim 10, wherein the component is a concrete pile cap for upgrading the structure of an existing railroad bridge.

12. The system of claim 10, wherein the first member comprises a portion of an oil well drilling pipe cast in the body and having a female thread formed at the first threaded end.

13. The system of claim 10, wherein the first member has a second end exposed on a second surface of the body, the second end capable of draining water from the first threaded end exposed on the first surface.

14. The system of claim 10, wherein the second member comprises a portion of an oil we drilling pipe having a male thread formed at the second threaded end.

15. The system of claim 10, wherein the component comprises a plurality of first members in he body spaced at a plurality of lifting points on the component, each first member having a first threaded end exposed on the first surface.

16. The system of claim 15, wherein the device comprises:

a support member having a plurality of support locations being substantially equally spaced as the lifting points on the component; and a plurality of second members disposed on the support member at the lifting locations, each of the second members being movable between extended and retracted positions in the support member for handling the component in restrictive areas of the structure.

17. The system of claim 16, wherein one of the plurality of second members has a second end connectable to the cable of the crane.

18. A system using a cable for handling components of a structure having an obstruction, the system comprising:

a component of the structure having a plurality of lifting points formed on a surface of the component; and a device for moving the component, comprising:

a bar moved by the cable, and a plurality of rods disposed on the bar and movable between extended and retracted positions on the bar, each rod having a first end connecting to one of the lining points formed on the component when the rod is in the extended position, wherein the plurality of rods are alternatingly movable between the extended and retracted positions on the bar and the first ends of the rods are alternatingly connectable to the lifting points on the component for moving the component past the obstruction of the structure when interposed between the component and the bar.

19. The system of claim 18, wherein the component is a concrete pile cap for upgrading the structure of an existing railroad bridge.

20. The system of claim 18, wherein the lifting points of the component each comprise a threaded opening exposed on the surface of the component.

21. The system of claim 18, wherein the lifting points of the component each comprise a fist portion of an oil well drilling pipe cast in the component and having a threaded opening exposed on the surface of the component.

22. The system of claim 21, further comprising a reinforcing bar cast in the component and connected to the portions of the oil well drilling pipe.

23. The system of claim 21, wherein the first ends of the rods each comprise a second portion of an oil well drilling pipe attached to the rod and having a male thread threading with the treaded opening.

24. The system of claim 18, wherein the bar defines a plurality of holes being substantially equally spaced as the lifting points on the component and having the rods movably disposed therein.

25. The system of claim 18, wherein the first ends of the rods are housed within a hollow of the bar when the rods are in the retracted position.

26. The system of claim 18, wherein the plurality of rods comprises a central rod having a second end connecting to the cable and having a first stop for engaging the bar when the central first rod is in the retracted position.

27. The system of claim 18, wherein the plurality of rods comprises a second rod having a second stop for engaging the bar when the second rod is in the extended position.

* * * * *

UNITED STATES PATENT AND TRADEMARK OFFICE

CERTIFICATE OF CORRECTION

PATENT NO. : 6,701,564 B2
DATED : March 9, 2004
INVENTOR(S) : Snead

It is certified that error appears in the above-identified patent and that said Letters Patent is hereby corrected as shown below:

Column 12,
Line 21, please replace “interconnected” with --interconnecting. --
Line 25, please replace “loaded” with -- located. --
Line 46, please replace “treaded” with -- threaded. --
Line 64, please replace “he” with -- the. --

Column 14,
Line 16, please replace “treaded” with -- threaded. --

Signed and Sealed this

Fifteenth Day of June, 2004

JON W. DUDAS
*Acting Director of the United States Patent and Trademark Office*